US008061742B2

(12) United States Patent
Machida et al.

(10) Patent No.: US 8,061,742 B2
(45) Date of Patent: Nov. 22, 2011

(54) DOOR LOCKING SYSTEM FOR VEHICLE

(75) Inventors: Toshio Machida, Toyota (JP); Jun Ishida, Anjo (JP); Yoshinobu Ogura, Kariya (JP); Shinsuke Takayanagi, Okazaki (JP)

(73) Assignees: Aisin Seiki Kabushiki Kaisha, Kariya-Shi, Aichi-Ken (JP); Aisin Kiko Co., Ltd., Hazu-Gun, Aichi-Ken (JP)

( * ) Notice: Subject to any disclaimer, the term of this patent is extended or adjusted under 35 U.S.C. 154(b) by 912 days.

(21) Appl. No.: 11/931,861

(22) Filed: Oct. 31, 2007

(65) Prior Publication Data

US 2008/0105011 A1 May 8, 2008

(30) Foreign Application Priority Data

Nov. 6, 2006 (JP) ..... 2006-300208

(51) Int. Cl.
*E05C 3/06* (2006.01)

(52) U.S. Cl. ..... 292/201; 292/213; 292/DIG. 23

(58) Field of Classification Search ..... 292/201, 292/216, DIG. 23, DIG. 64, DIG. 53
See application file for complete search history.

(56) References Cited

U.S. PATENT DOCUMENTS 6,685,239 B2 * 2/2004 Yamauchi et al. ..... 292/201
7,445,256 B2 * 11/2008 Gotou et al. ..... 292/216
7,614,670 B2 * 11/2009 Hayakawa et al. ..... 292/216
2001/0005079 A1 * 6/2001 Takamura ..... 292/201
2006/0290142 A1 12/2006 Tani et al.

FOREIGN PATENT DOCUMENTS

JP 2001-098819 A 4/2001
JP 2001-182406 A 7/2001
JP 2002-38796 A 2/2002

OTHER PUBLICATIONS

Office Action issued Mar. 23, 2010 by the Japanese Patent Office in Japanese Application No. 2006-300208 and English language translation of Office Action.

* cited by examiner

*Primary Examiner* — Kristina Fulton
(74) *Attorney, Agent, or Firm* — Buchanan Ingersoll & Rooney PC

(57) ABSTRACT

A door locking system for a vehicle includes a striker, a latch, a pawl allowing and regulating the latch to rotate, a lock release operating portion moving the pawl to release the regulation on the latch rotation, a latch driving motor driven in one direction to shift the door to a fully closed state from a half-closed state, the latch driving motor driven in the other direction to move the pawl to be release position when the lock release operating portion is operated, and a power transmission system switching mechanism connecting a motor output shaft of the motor to the latch for driving the latch in the locking direction, the power transmission system switching mechanism connecting the motor output shaft of the motor to the pawl for moving the pawl to the release position and including a first canceling mechanism for switching a power state.

18 Claims, 16 Drawing Sheets

DOOR LOCKING SYSTEM FOR VEHICLE

CROSS REFERENCE TO RELATED APPLICATIONS

This application is based on and claims priority under 35 U.S.C §119 with respect to Japanese Patent Application 2006-300208, filed on Nov. 6, 2006, the entire content of which is incorporated herein by reference.

FIELD OF THE INVENTION

The invention relates to a door locking system for a vehicle. In particular, the invention relates to a door locking system for a vehicle mounted to a vehicle door and provided with a latch, which engages with a striker provided at a vehicle body and rotates, and a pawl, which allows the latch to rotate in a locking direction and regulates the latch to rotate in a lock releasing direction.

BACKGROUND

A door locking system for a vehicle, in which a latch is rotationally driven by a latch driving motor to bring the door in a fully closed state when a door is brought in a half closed state, is known as one of the above-described door locking systems for the vehicle. Here, when the door is brought in the fully closed state, a sound-proofing member is strongly pressed between the door and the vehicle body, and the latch and a pawl are pressed each other by the reaction force to be frictionally engaged. Then, the frictional engagement leads to an operational resistance when operating a door handle. Thus, the known door locking system for the vehicle is provided with a release motor in addition to the latch driving motor, and the release motor rotationally drives the pawl depending on the operation of the handle to disengage the pawl from the latch (for example, refer to JP 2001-98819A, paragraph [0025], [0028], FIG. 2).

However, the manufacturing cost for the aforementioned known door locking system for the vehicle increases because the door locking device is provided with two power sources, one is for the latch driving motor and the other is for the release motor, and thus prohibiting the progress of this kind of door locking system for the vehicle.

A need exists for a seat for a vehicle which is not susceptible to the drawback mentioned above.

SUMMARY OF THE INVENTION

According to an aspect of the present invention, a door locking system for a vehicle includes a striker adapted to be provided at a vehicle body, a latch adapted to be mounted to a vehicle door, the latch engaging with the striker and rotating, a pawl engaging with the latch, the pawl allowing the latch to rotate in a locking direction that strengthens the engagement between the latch and the striker and regulating the latch to rotate in a lock releasing direction that is a reverse direction of the locking direction, a lock release operating portion moving the pawl to a release position to release the regulation on the rotation of the latch, a latch driving motor rotationally driven in one direction to rotationally drive the latch in the locking direction to shift the door to a fully closed state in which the door is completely closed when the vehicle door falls into a half-closed state, the latch driving motor rotationally driven in the other direction to move the pawl to the release position when the lock release operating portion is operated, and a power transmission system switching mechanism disposed between the latch driving motor, the pawl and the latch, the power transmission system switching mechanism connecting a motor output shaft of the latch driving motor, which is rotationally driven in the one direction, to the latch for rotationally driving the latch in the locking direction, and connecting the motor output shaft of the latch driving motor, which is rotationally driven in the other direction, to the pawl for moving the pawl to the release position, the power transmission system switching mechanism including a first canceling mechanism for switching a power state between a power transmitting state, in which power and a reaction force are transmitted from the motor output shaft to the pawl, and a power shutoff state, in which the power and the reaction force are shut off from the motor output shaft and the pawl.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be described below with reference to FIGS. 1 to 14, FIG. 1 shows a vehicle having a slide door 90 provided with a door locking system for the vehicle 10, When the slide door 90 is opened from the state that an entrance of a vehicle body 99 is closed, the slide door is slid obliquely backward and then is slid straight back to be brought to a fully opened state. Then, the door locking system for the vehicle 10 is provided with a closed door locking device 10A, a fully opened door locking device 10C, a closing device 10B, and a remote control device 91. The closed door lock device 10A holds the slide door 90 in a closed state and the fully opened door locking device 10C holds the slide door 90 in the fully opened state. The closing device 10B brings the slide door 90 from a half-closed state to a fully closed state.

Figure 2:
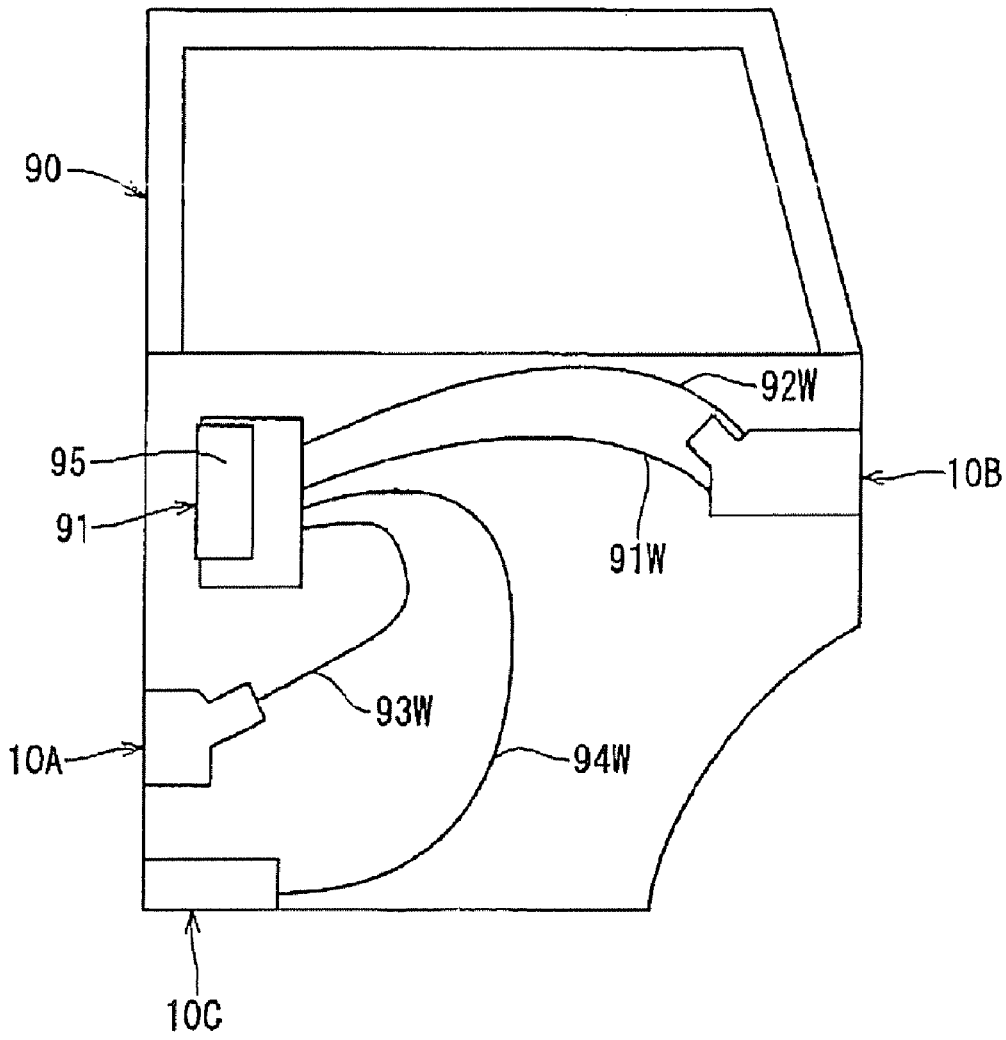
FIG. 2 is a schematic diagram of a slide door provided with the door locking system for the vehicle.

As illustrated in FIG. 2, the closed door locking device 10A and the fully opened door locking device 10C are respectively disposed at intermediate and lower portions with respect to an elevational direction of the slide door 90 on a front end thereof. The closing device 10B is disposed at an intermediate portion with respect to the elevational direction of the slide door 90 on a rear end thereof. Strikers 40 are provided at three positions on an inner side surface of a door frame 99W (the frame of the entrance) corresponding to the door locking devices 10A and 10C and the closing device 10B.

Figure 1:
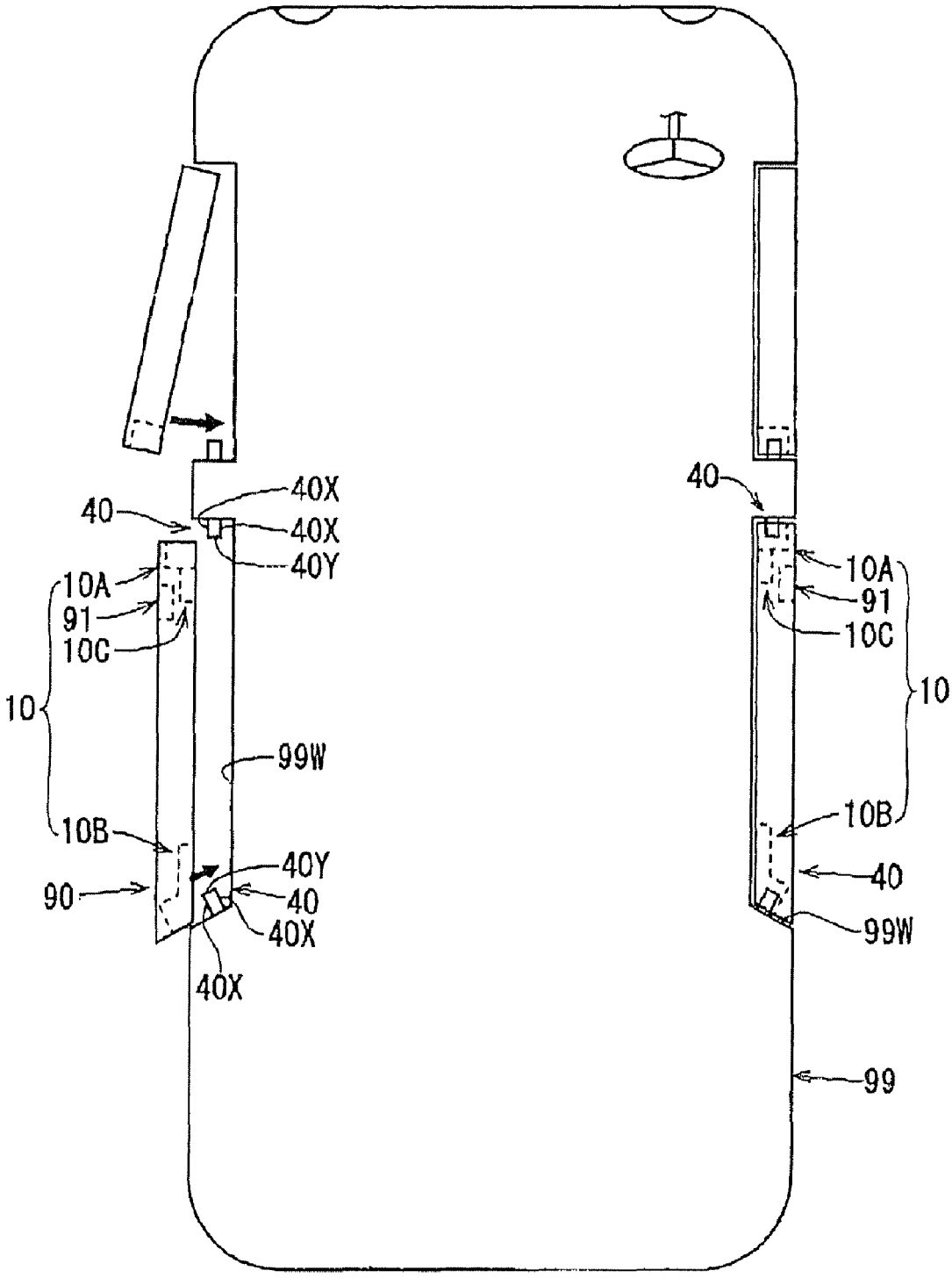
FIG. 1 is a schematic diagram of a vehicle provided with a door locking system for a vehicle according to an embodiment of the present invention.

Each striker 40 is formed by bending a material having a circular section such as a wire rod and forms a U-shape which is composed of a pair of legs 40X and a connecting bar 40Y connecting the distal ends of the legs 40X each other. The striker 40 corresponding to the closed door locking device 10A extends horizontally rearward from a front inner side surface of the door frame 99W and the legs 40X are respectively arranged at inner and outer sides of the door frame 99W. The closed door locking device 10A engages with one of the legs 40 which is arranged at the outer side of the door frame 99W. In FIGS. 3 to 6, only a part of the striker 40, which engages with the closed door locking device 10A, is shown in cross section. Also, the striker 40 corresponding to the closing device 10B extends horizontally forward from a rear inner side surface of the door frame 99W and the legs 40X are respectively arranged at the inner and outer sides of the door frame 99W. The closing device 10B engages with one of the legs 40X which is arranged at the outer side of the door frame 99W. In FIGS. 8 to 12, only a part of the striker 40, which engages with the closing device 1013, is shown. Further, the pair of legs 40X of the striker 40 corresponding to the fully opened door locking device 10C, which is shown in FIG. 1, extends horizontally forward from the rear inner side surface of the door frame 99W. The legs 40X are vertically arranged at the door frame 99W and the fully opened door locking device 10C engages with the connecting bar 40Y of the striker 40.

Figure 3:
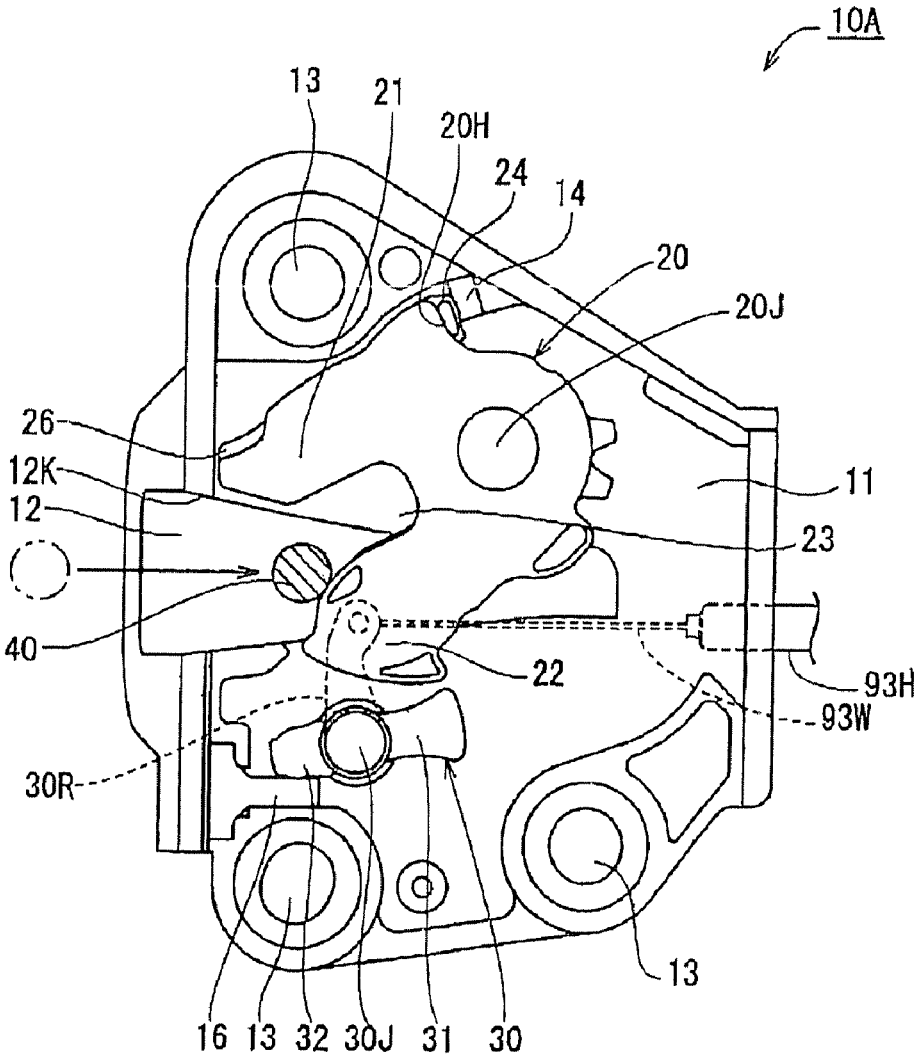
FIG. 3 is a front view of a closed door locking device in an unlatched state.

As illustrated in FIG. 3, the closed door locking device 10A is provided with a base board 11 to which a latch 20 and a pawl 30 are rotatably assembled. The base board 11 is provided with bolt fixing holes 13 disposed at several positions and is put on the inside of a front end wall of the slide door 90 to be fixed with bolts each penetrating into (or screwed) the bolt fixing hole 13.

A striker receiving groove 12 extending in a horizontal direction is provided at the base board 11. One end portion of the striker receiving groove 12 forms a striker receiving aperture 12K which opens to the inside of the vehicle, and the other end portion thereof is closed. Further, a notch (not shown) corresponding to the striker receiving groove 12 is provided on one end wall of the slide door 90 to which the base board 11 is mounted. When the slide door 90 is closed, the striker 40 enters from the striker receiving aperture 12K into the striker receiving groove 12.

The pawl 30 is rotatably journalled at a lower potion of the base board 11 relative to the striker receiving groove 12 and is provided with a latch rotation regulating piece 31 and a stopper piece 32 in a manner that protrudes the latch rotation regulating piece 31 and the stopper piece 32 respectively in two opposing direction from a rotational shaft 30J. Also, a torsion spring, not shown, is provided between the pawl 30 and the base board 11. The pawl 30 is biased by the torsion spring in a counter clockwise direction of FIG. 3, and is positioned by contacting the stopper piece 32 with a pawl stopper 16 provided at the base board 11.

Also, the pawl 30 is provided with a pawl driving lever 30R at the corresponding position with the pawl 30 and the stopper piece 32 on the other side of the base board 11 and the pawl driving lever 30R and the remote control device 91 are connected by an open cable 93W. An intermediate portion of the open cable 93W is covered by a cladding tube 93H. When the open cable 93W is drawn toward the remote control device 91, the pawl 30 rotates in a clockwise direction of FIG. 3 and the latch rotation regulating piece 31 moves to a release position which is away from a rotational range of the below-mentioned latch 20.

The latch 20 is rotatably journalled at an upper potion of the base board 11 relative to the striker receiving groove 12. The latch 20 is soundproofed by covering a metal plate with a resin layer. The latch 20 is provided with a pair of engaging pawls 21 and 22 which are parallel, and a striker receiving portion 23 is formed between the engaging pawls 21 and 22. Further, the latch 20 is biased in a lock releasing direction (clockwise direction of FIG. 3) by a torsion spring (not shown) provided between the latch 20 and the base board 11. When the slide door 90 is open, a stopper contacting portion 24 provided at the latch 20 contacts with a latch stopper 14 provided at the base board 11 to position the latch 20 at an unlatched position (a position indicated in FIG. 3).

Figure 4:
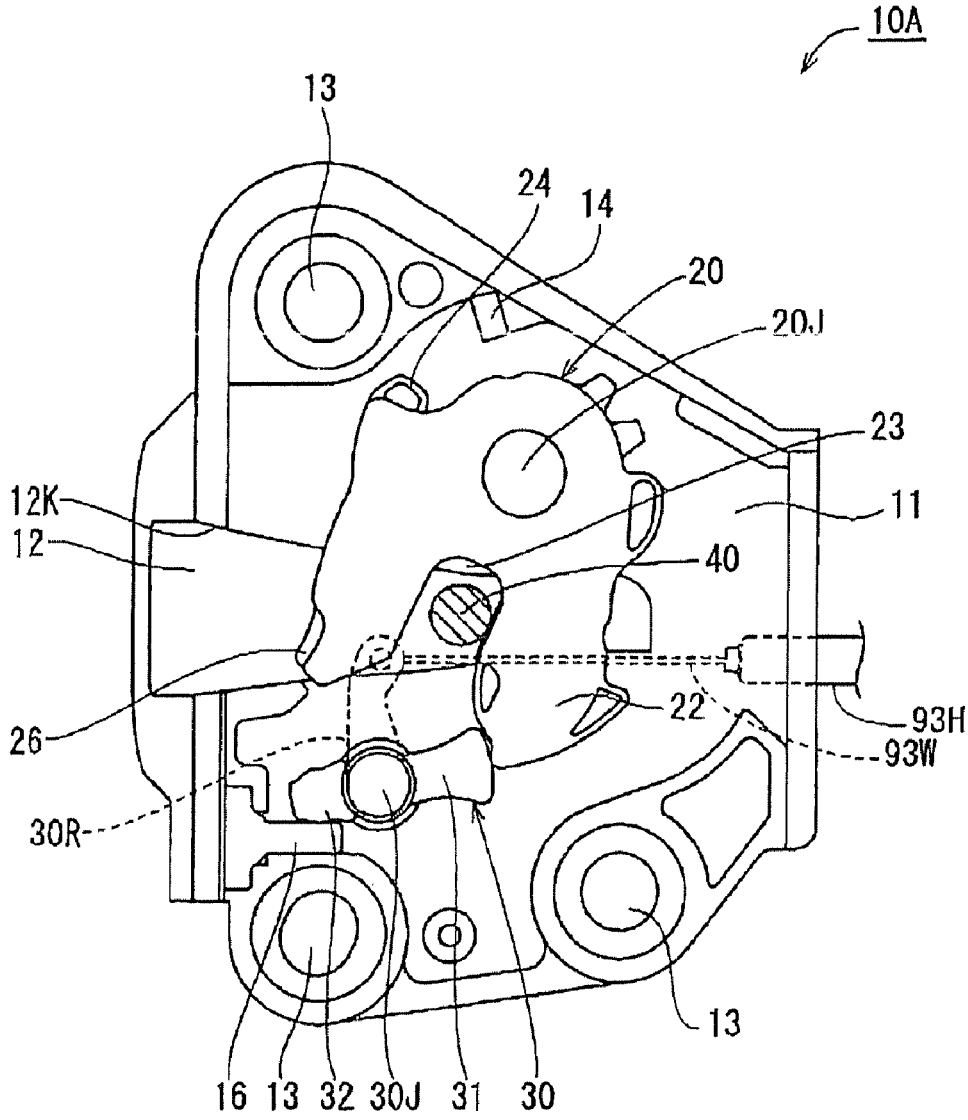
FIG. 4 is a front view of the closed door locking device in a half-latched state.

In the unlatched position, the front engaging pawl 21 is moved above the striker receiving groove 12 and the rear engaging pawl 22 crosses the striker receiving groove 12. At His time, an opening edge of the striker receiving portion 23 faces the striker receiving aperture 12K of the striker receiving groove 12 and the striker 40 enters into the striker receiving groove 12 to be received by the striker receiving portion 23. Also, the striker 40 pushes the rear engaging pawl 22 to rotate the latch 20 in the locking direction (counter clockwise direction in FIG. 3) and thereby blocking up a part of the striker receiving groove 12 which is located closer to the striker receiving aperture 12K with respect to the striker 40 with the front engaging pawl 21 as shown in FIG. 4. Also, the front engaging pawl 21 protrudes between the legs 40X (refer to FIG. 1) of the striker 40 to engage the latch 20 with the striker 40.

Figure 5:
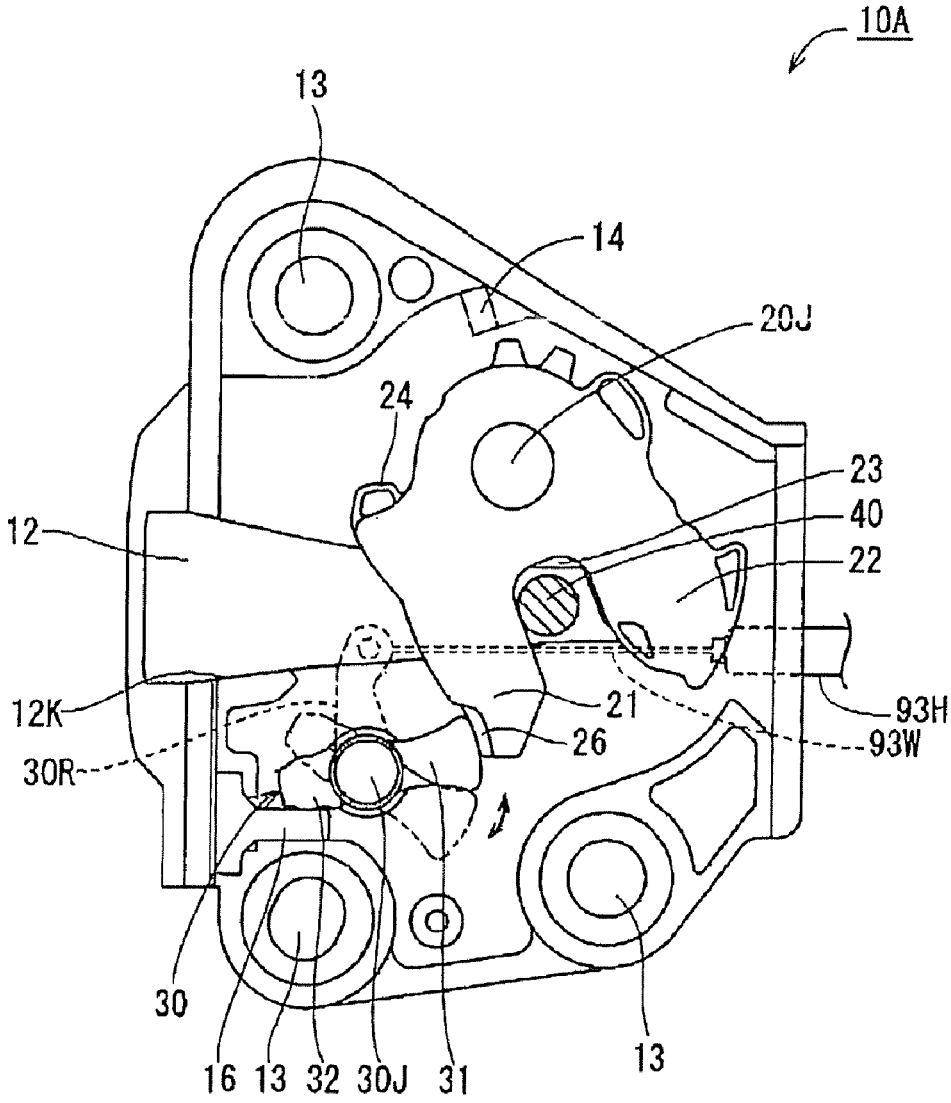
FIG. 5 is a front view of the closed door locking device in a full latched state.
Figure 6:
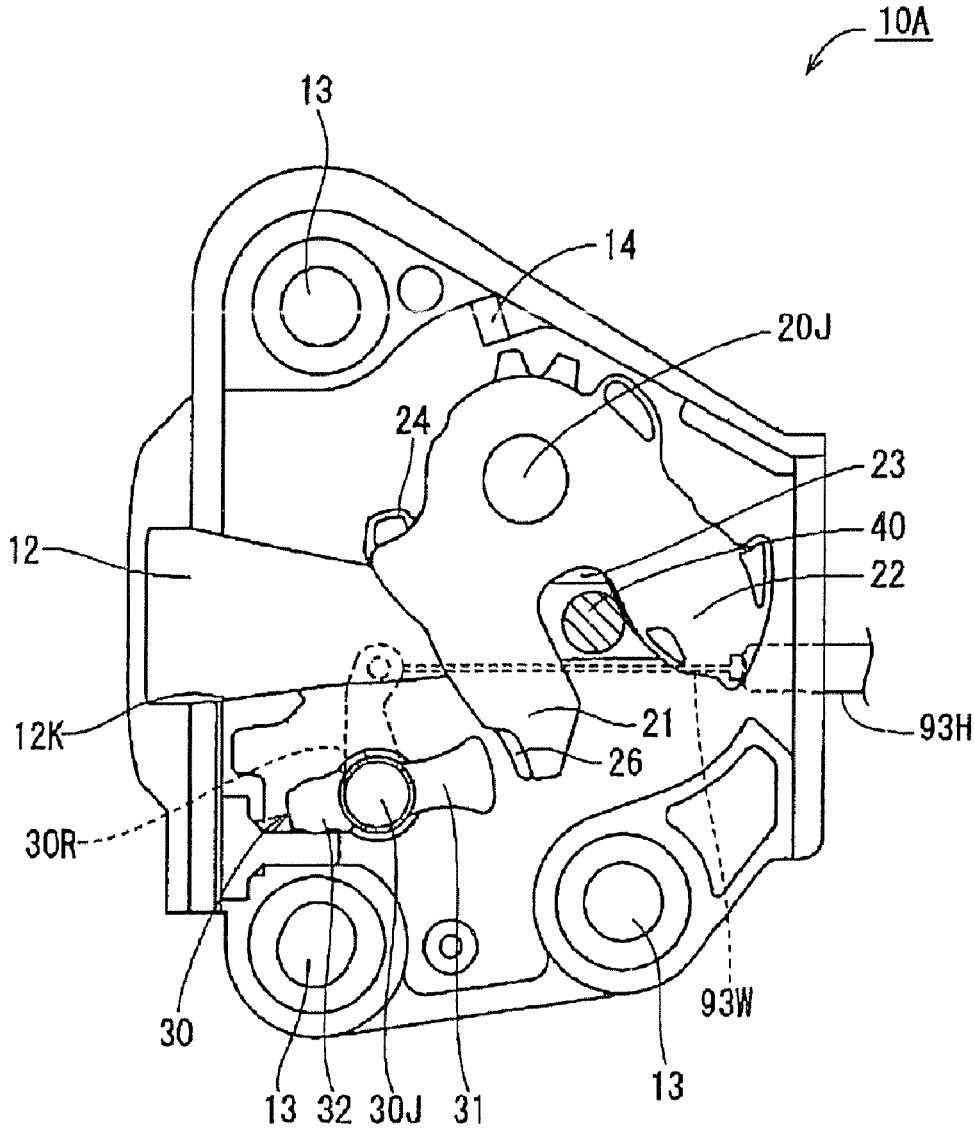
FIG. 6 is a front view of the closed door locking device in an over-latched state.

When the slide door 90 is closed with an excessive force, the slide door 90 reaches a position where the sound-proofing member (not shown) between the slide door 90 and the door frame 99W is strongly pressed at a maximum. At this time, as shown in FIG. 6, the latch 20 passes the pawl 30 and reaches an over-stroke position where is spaced slightly apart from the pawl 30. Then, the slide door 90 is moved back by an elastic force of the sound-proofing member and the latch 20 is slightly moved back from the over-stroke position toward the unlatched position in response to the movement of the slide door 90. Consequently, as shown in FIG. 5, the front engaging pawl 21 of the latch 20 contacts with the latch rotation regulating piece 31 of the pawl 30 to position the latch 20 at a full latched position. More specifically, a pawl contacting portion 26 exposing from the aforementioned resin layer is provided at a distal end portion of the front engaging pawl 21. Metals composing the pawl contacting portion 26 and the latch rotation regulating piece 31 contact with each other and thereby regulating the rotation of the latch 20 in the lock releasing direction to hold the slide door 90 in the fully closed state.

When the slide door 90 is closed with an insufficient force, the slide door 90 is moved back by the elastic force of the sound-proofing member before the latch 20 reaches the over-stroke position or the full latched position. Then, as shown in FIG. 4, the pawl 30 contacts with a distal end portion of the rear engaging pawl 22 of the latch 20 and the latch 20 is positioned at a half-latched position. As a result, the slide door 90 is brought into a so-called half-closed state. That is how the closed door locking device 10A is configured. Next, the configuration of the closing device 10B will be described.

Figure 7:
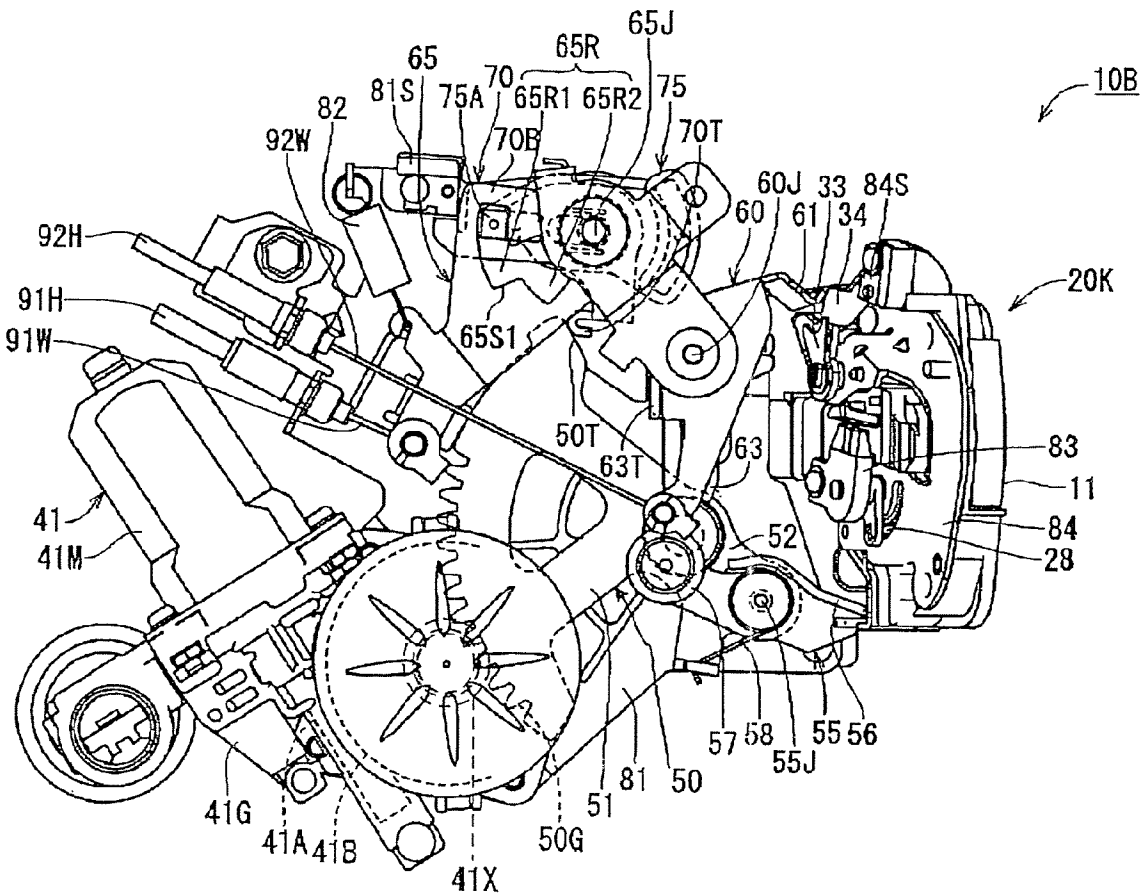
FIG. 7 is a front view of a closing device.
Figure 8:
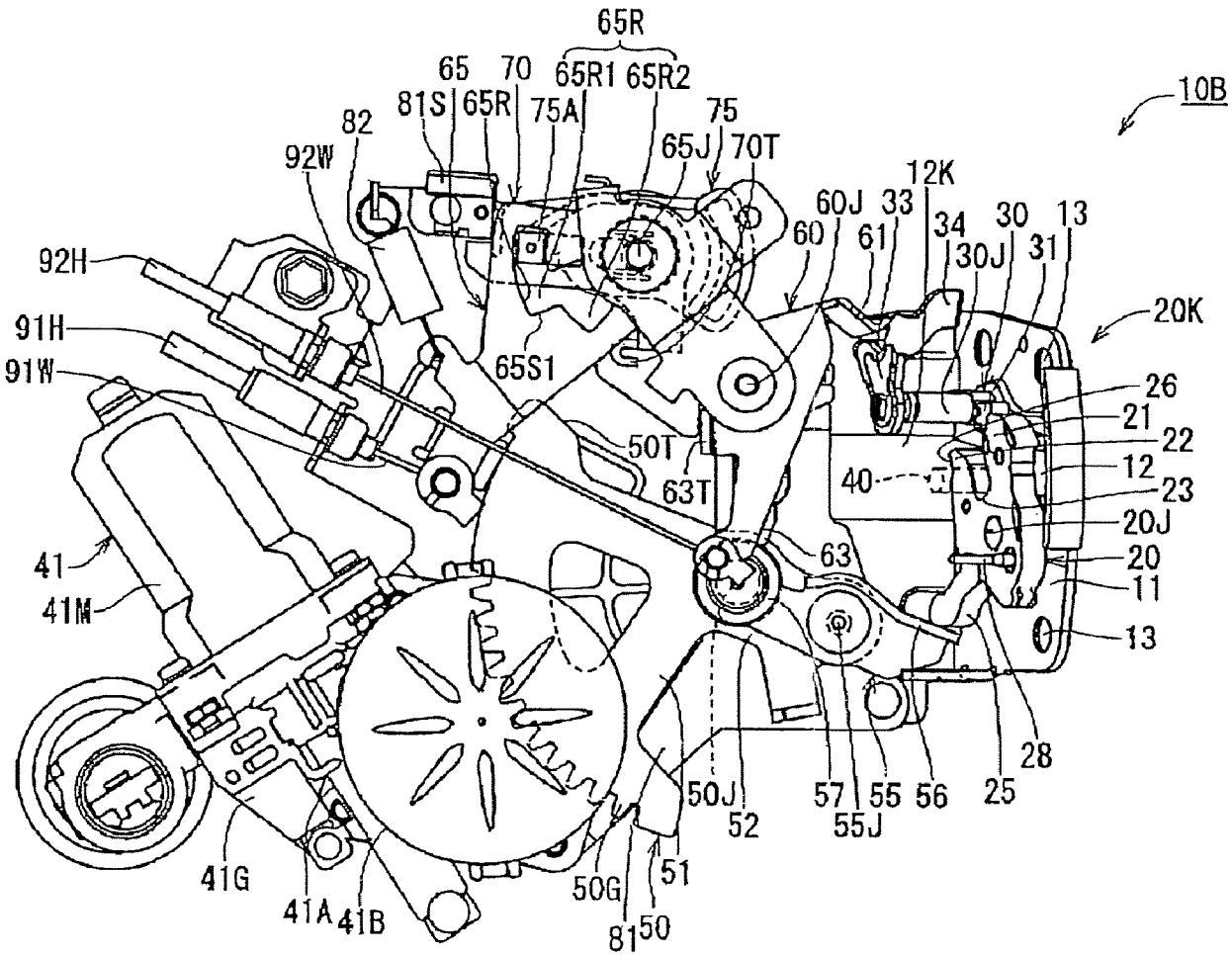
FIG. 8 is a front view of the closing device in the half-latched state.

The closing device 10B is shown in FIGS. 7 to 15. As shown in FIG. 8, the closing device 10B is provided with a latch and pawl mechanism 20K having the latch 20, the pawl 30, the striker receiving groove 12 and the like, which are similar to those of the closed door locking device 10A. The latch and pawl mechanism 20K is different from the closed door locking device 10A in the following points: a rotational shaft 20J of the latch 20 and the rotational shaft 30J of the pawl 30 are respectively disposed at lower and upper sides relative to the striker receiving groove 12 and a latch driving lever 25 and a position detecting pin 28 are provided at the rear engaging pawl 22. Hereinafter, lice reference numeral are given to identical or corresponding components between the closing device 10B and the closed door locking device 10A and the duplicated description is omitted. Thus, the explanation will be provided to only a different configuration.

As illustrated in FIG. 7, a sheet metal of the base board 11 of the closing device 10B is angled obtusely and the striker receiving aperture 12K (shown in FIG. 10) is provided at the angled portion. A mechanical plate 81 is connected to the base board 11 at a distal end portion located on one side of the angled portion overlapping the base board 11. The latch and pawl mechanism 20K is provided on an inner surface of the other side of the angled portion. Also, the latch 20 of the latch and pawl mechanism 20K is covered by a latch and pawl cover 84.

As illustrated in FIG. 8, the latch driving lever 25 and the position detecting pin 28 are provided at the latch 20. The latch driving lever 25 extends in a direction perpendicular to an axial direction of the rotational shaft 20J of the latch 20. When the latch 20 is in the half-latched position (refer to FIG. 8), the latch driving lever 25 faces obliquely downward. The latch driving lever 25 is pushed upward by a swing type rotation board 55 (corresponding to a swing type rotation portion), which is described below, from the above-described state, and the latch 20 moves to the full latched position (refer to FIG. 9). Also, the position detecting pin 28 is disposed at a position deviated downward from the rotational shaft 20J of the latch 20 and extends in a direction moving away from the base board 11 in parallel with the axial direction of the rotational shaft 20J. Also, as shown in FIG. 7, a distal end portion of the position detecting pin 28 is connected to a latch position detecting sensor 83 penetrating through the latch and pawl cover 84, and the latch position detecting sensor 83 detects which of the half latched position (refer to FIG. 8), the full latched position (refer to FIG. 9), and the unlatched position (refer to FIG. 11) the latch 20 is disposed at.

As illustrated in FIG. 8, the rotational shaft 30J of the pawl 30 extends in the direction moving away from the base board 11 and the distal end portion thereof penetrates through the latch and pawl cover 84 as shown in FIG. 7. Also, a pawl driving lever 33 protrudes laterally from the distal end portion of the rotational shaft 30J. A distal end portion of the pawl driving lever 33 is split into two portions and a stopper piece 34 protrudes from one distal end portion of the two portions. The stopper piece 34 contacts with a stopper 84S provided at the latch and pawl cover 84, and thereby positioning the pawl 30 at a position in which the pawl 30 is able to regulate the rotation of the latch 20. The other distal end portion of the two portions of the pawl driving lever 33 may be pushed down by a push-down piece 61 of the below-described opening lever 60. The latch rotation regulating piece 31 of the pawl 30 moves to the release position where is away from the rotational range of the latch 20 by pushing down the pawl driving lever 33 to release the regulation on the rotation of the latch 20.

Components of a power transmission system switching mechanism are mounted to the mechanical plate 81. Details are described below. An active lever 50 (corresponding to an active rotation portion) is rotatably journalled in a position which is close to a lower end of the mechanical plate 81. The active lever 50 is provided with the latch and pawl mechanism 20K at one side and a fan-shaped rotational plate 51 at the other side sandwiching a rotational shaft 50J therebetween, and a gear 50G is formed on an outer peripheral edge of the fan-shaped rotational plate 51. Further, the active lever 50 is provided with a rotation support protruding piece 52 protruding toward the latch and pawl mechanism 20K from the rotational shaft 50J, and the swing type rotation board 55 is rotatably journalled by a distal end portion of the rotation support protruding piece 52.

The swing type rotation board 55 forms a swing type structure in which a rotating piece extends to both sides sandwiching the rotational shaft 55J between the extended portions, and a push-up wall 56 is bent to be raised toward the side opposite to the mechanical plate 81 at an upper edge of the swing type rotation board 55. The push-up wall 56 extends from above the rotational shaft 55J to a distal end portion of the swing type rotation board 55 located in the vicinity of the latch and pawl mechanism 20K and may contact with the latch driving lever 25 from downward. Also, the swing type rotation board 55 is biased in a direction that the push-up wall 56 moves away from the latch driving lever 25 (clockwise direction of FIG. 8) by a torsion coil spring 58 shown in FIG. 7.

A contacting roller 57 is mounted to an end portion of the swing type rotation board 55, which is located on the side opposite to the latch and pawl mechanism 20K, and a positioning lever 63 (corresponding to a movable positioning member), which will be described below, is butted to the contacting roller 57 from upward. A second canceling mechanism is configured by the active lever 50, the swing type rotation board 55 and the positioning lever 63. When the active lever 50 rotates in a counter clockwise direction of FIG. 8 with the contacting roller 57 positioned by the positioning lever 63, the rotational shaft 55J of the swing type rotation board 55 moves upward and the push-up wall 56, which is located at the distal end portion of the swing type rotation board 55, pushes up the latch driving lever 25. Also, when the positioning lever 63 moves a position where is away from the contacting roller 57, the swing type rotation board 55 may rotate freely relative to the active lever 50. Thus, the transmission of the power is shut off from the active lever 50 to the swing type rotation board 55, and the push-up wall 56 of the swing type rotation board 55 becomes unable to push up the latch driving lever 25.

As shown in FIG. 7, an actuator 41 is provided at the side opposite to the latch and pawl mechanism 20K sandwiching the active lever 50 therebetween. The actuator 41 is composed of a latch driving motor 41M and a decelerating mechanism 41G. The decelerating mechanism 41G has a worm gear 41A and a worm wheel 41B built-in, and a motor output shaft of the latch driving motor 41M is connected to the worm gear 41A. A small gear 41X (refer to FIG. 7) integrally provided at the worm wheel 41B meshes with the gear 50G of the fan-shaped rotational plate 51. This enables the latch driving motor 41M to rotate the active lever 50 in directions, i.e. the clockwise direction or the counter clockwise direction.

As shown in FIG. 7, the positioning lever 63 and the opening lever 60 are rotatably journalled about a common rotational shaft 60J above the rotational shaft 50J of the active lever 50 in the mechanical plate 81. An end portion of an open cable 92W is connected to a distal end of a portion extending downwardly from the rotational shaft 60J of the opening lever 60 and the other end of the open cable 92W is connected to the remote control device 91 (refer to FIG. 16). An entire portion of the open cable 92W is covered by a cladding tube 92H except both ends thereof.

The push-down piece 61 protrudes toward the pawl 30 from an upper end portion of the opening lever 60. When the open cable 92W is drawn toward the remote control device 91, the opening lever 60 rotates and the push-down piece 61 pushes down the pawl driving lever 33. Consequently, as described above, the pawl 30 moves to the release position and the regulation on the rotation of the latch 20 by the pawl 30 is released.

The positioning lever 63 is provided overlapping the opening lever 60. A linking piece 63T raises from a side edge of the positioning lever 63 and faces one side edge of the opening lever 60 from a lateral direction thereof. When the open cable 92W is drawn toward the remote control device 91 and the opening lever 60 rotates, the linking piece 63T is pushed by the opening lever 60 to rotate the positioning lever 63. Then, the positioning lever 63 moves away from the contacting roller 57. Consequently, as described above, the transmission of the power is shut off from the active lever 50 to the swing type rotation board 55, and the push-up wall 56 of the swing type rotation board 55 becomes unable to push up the latch driving lever 25. In the embodiment, a position where the positioning lever 63 contacts with the contacting roller 57 corresponds to a power transmitting position related to the movable positioning member and a position where the positioning lever 63 is moved away from the contacting roller 57 corresponds to a power shutoff position related to the movable positioning member.

Figure 13A:
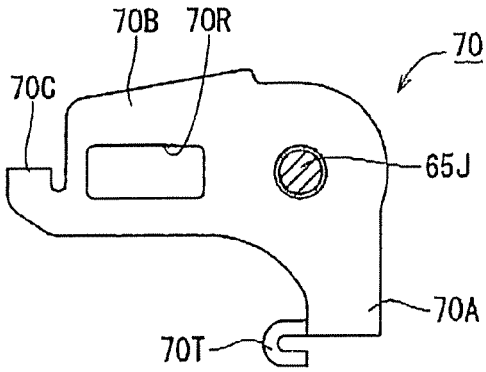
FIG. 13 is a front view of components structuring a first canceling mechanism.

Above the opening lever 60, a release input board 70, a sliding rotation board 75 (corresponding to a sliding rotation portion) and a releasing lever 65 (corresponding to a releasing rotation portion) are rotatably journalled about a common rotational shaft 65J to configure a first canceling mechanism. As shown in FIG. 13A, the release input board 70 has a first rotation piece 70A extending downwardly from the rotational shaft 65J and a second rotation piece 70B extending horizontally. An elongated hole 70R is formed along an axial line that intersects the rotational shaft 65J at the second rotation piece 70B. Additionally, a stopper contacting portion 70C, which faces upwardly, is formed at a distal end of the second rotation piece 70B. As shown in FIG. 7, the stopper contacting portion 70C contacts with a stopper 81S provided at the mechanical plate 81 and thereby positioning the release input board 70 at one end of the rotatable range.

A lower end portion of the first rotation piece 70A is bent to raise toward the mechanical plate 81. As shown in FIG. 7, the raised portion protrudes in a direction opposite to the latch and pawl mechanism 20K and bends in a U-shape to form a curved contacting portion 70T. When the active lever 50 is rotated in the clockwise direction by driving the latch driving motor 41M, a pressing portion 50T provided at the active lever 50 contacts with the curved contacting portion 70T and the release input board 70 rotates in the counter clockwise direction of FIG. 7.

Figure 13B:
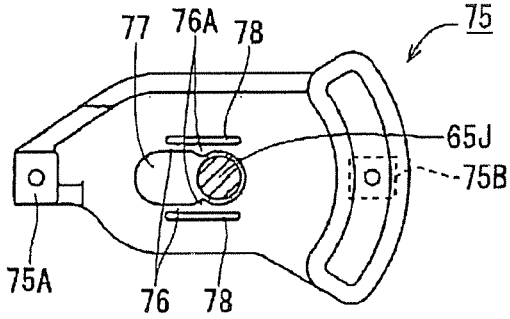

As shown in FIG. 7, the sliding rotation board 75 is disposed between the release input board 70 and the mechanical plate 81. Further, the sliding rotation board 75 extends in a longitudinal direction of the second rotation piece 70B in the release input board 70. The width of the sliding rotation board 75 is narrowed toward the distal end thereof, while the width is broadened toward the proximal end thereof. As shown in FIG. 13B, an elongated hole 77 is formed at the sliding rotation board 75 so as to extend in the longitudinal direction of the sliding rotation board 75 and a pair of slits 78 is formed on both sides of the elongated hole 77 in parallel with the elongated hole 77. Also, a pair of protrusions 76A is formed at a position where is close to the proximal end portion of the elongated hole 77 (position close to a right side of FIG. 13B) on both inner surfaces of the elongated hole 77. The rotational shaft 65J penetrating through the proximal end portion of the elongated hole 77 engages with the protrusions 76A, thereby regulating the movement of the sliding rotation board 75 in the direction that intersects the axial direction of the rotational shaft 65J. Also, when an external force is applied in the longitudinal direction of the sliding rotation board 75, both end supporting beams formed between the long hole 77 and each slit 78 are deflected and the protrusions 76A get over the rotational shaft 65J to slide the sliding rotation board 75. Here, when the rotational shaft 65J is positioned at the proximal end portion of the elongated hole 77 (right end portion of FIG. 13B), a position of the sliding rotation board 75 corresponds to a power transmitting position related to the sliding rotation portion. When the rotational shaft 65J is positioned at the distal end portion of the elongated hole 77 (left end portion of FIG. 13B), a position of the sliding rotation board 75 corresponds to a power shutoff position of the sliding rotation portion.

A cancel operating protrusion 75B (corresponding to a cancel operating portion) is provided at the proximal end portion of the sliding rotation board 75 for sliding the sliding rotation board 75 between the power transmitting position to the power shutoff position. The proximal end portion of the sliding rotation board 75 exposes from an outer peripheral portion of the mechanical plate 81 in a lateral direction and the cancel operating protrusion 75B protrudes from the exposed portion. In addition, a connecting rotation protrusion 75A protrudes from the distal end portion of the release input board 70 to a direction that moves away from the mechanical plate 81. The connecting rotation protrusion 75A forms a prismatic shape having a substantially identical width to the elongated hole 70R of the release input board 70 and penetrates through the elongated hole 70R to be received by a crank groove 65R of the releasing lever 65, which is described below.

Figure 13C:
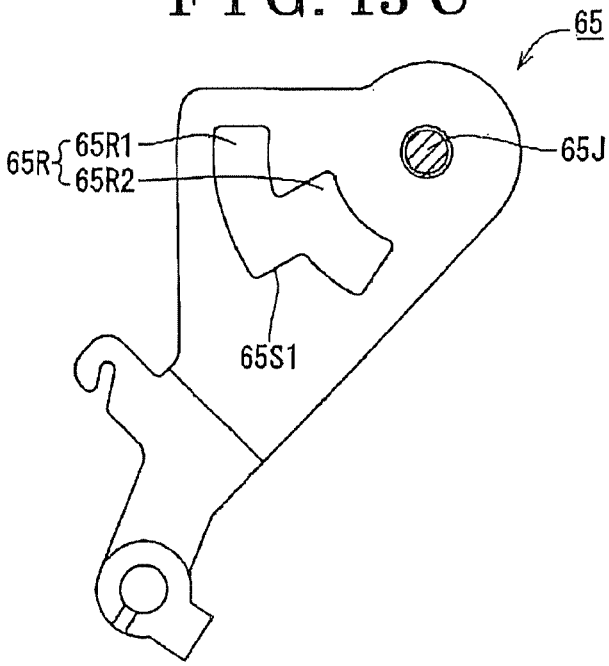
Figure 14:
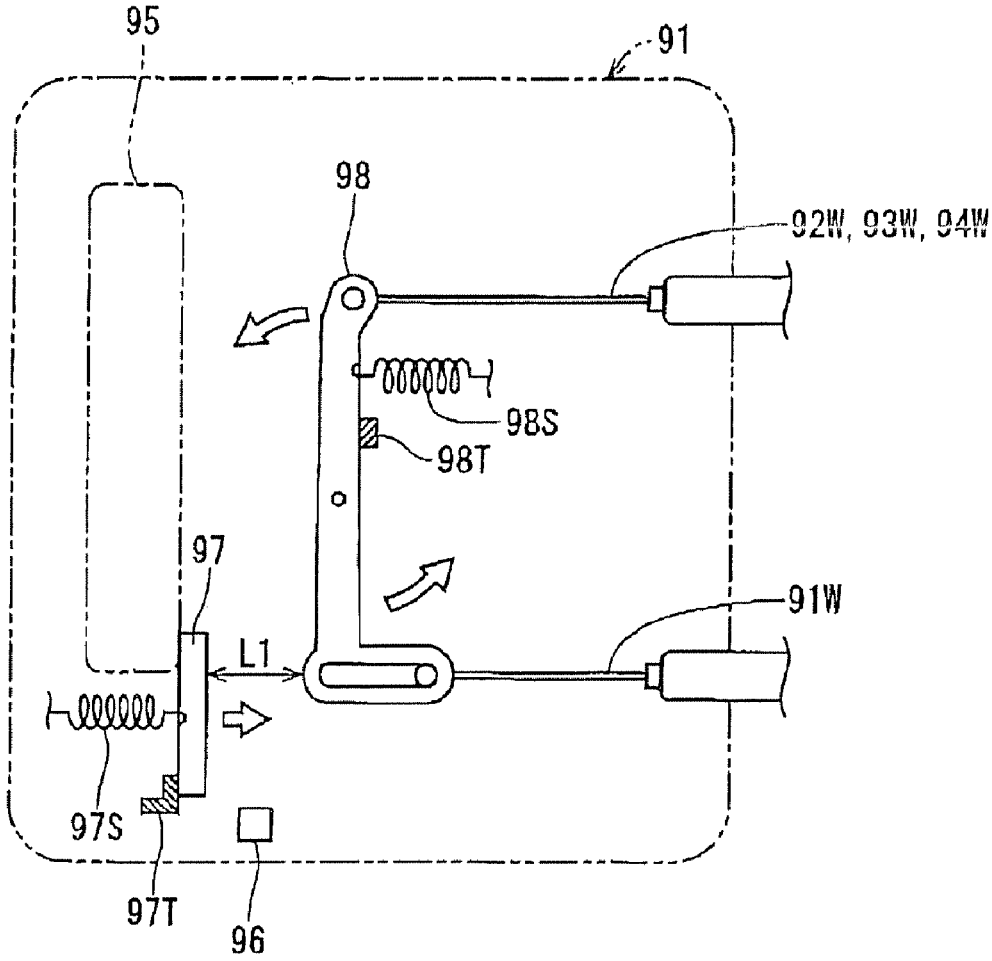
FIG. 14 is a schematic diagram of a remote control device.

As shown in FIG. 13C, the releasing lever 65 extends obliquely downward from the rotational shaft 65J, and one end of a releasing cable 91W is connected to a lower portion of the releasing lever 65 as shown in FIG. 7. The other end portion of the releasing cable 91W is connected to the remote control device 91 and an intermediate portion of the releasing cable 91W is covered by a cladding tube 91H. The releasing lever 65 is biased in the clockwise direction of FIG. 7 by a spring 82. Further, the width of the releasing lever 65 is broaden from the proximal end portion, which is close to the rotational shaft 65J, to the intermediate portion thereof to form a fan-shape and the crank groove 65R is formed at the fan shaped portion. As shown in FIG. 13C, the crank groove 65R in formed so as to connect an outer circular arc groove 65R1 and an inner circular arc groove 65R2 (corresponding to a protrusion receiving portion). The outer circular arc groove 65R1 is formed in a circular arc shape with the rotational shaft 65J serving a center thereof and the inner circular arc groove 65R2 is formed so as to have a smaller diameter than the outer circular arc groove 65R1. The entire crank groove 65R is formed in a substantially crank shape. As shown in FIGS. 7 to 11, when the sliding rotation board 75 is positioned in the power transmitting position, the connecting rotation protrusion 75A is received by the outer circular arc groove 65R1. When the sliding rotation board 75 is positioned in the power shutoff position, the connecting rotation protrusion 75A is received by the inner circular arc groove 65R2.

When the power is transmitted from the active lever 50 and the release input board 70 rotates while the connecting rotation protrusion 75A is being received by the outer circular arc groove 65R1, the sliding rotation board 75 rotates unitarily therewith. Then, as show in a change observed from FIG. 9 to FIG. 10, the connecting rotation protrusion 75A moves from one side to the other side in the outer circular arc groove 65R1 to contact with a protrusion contacting portion 65S1 located on an end portion of the outer circular arc groove 65S1. When the release input board 70 and the sliding rotation board 75 further rotate, as shown in a change observed from FIG. 10 to FIG. 11, then the connecting rotation protrusion 75A pushes the protrusion contacting portion 65S1 and the releasing lever 65 receives the power from the sliding rotation board 75 to rotate. In conjunction with the rotation, the open cable 92W is drawn from the remote control device 91 toward the closing device 10B.

Figure 11:
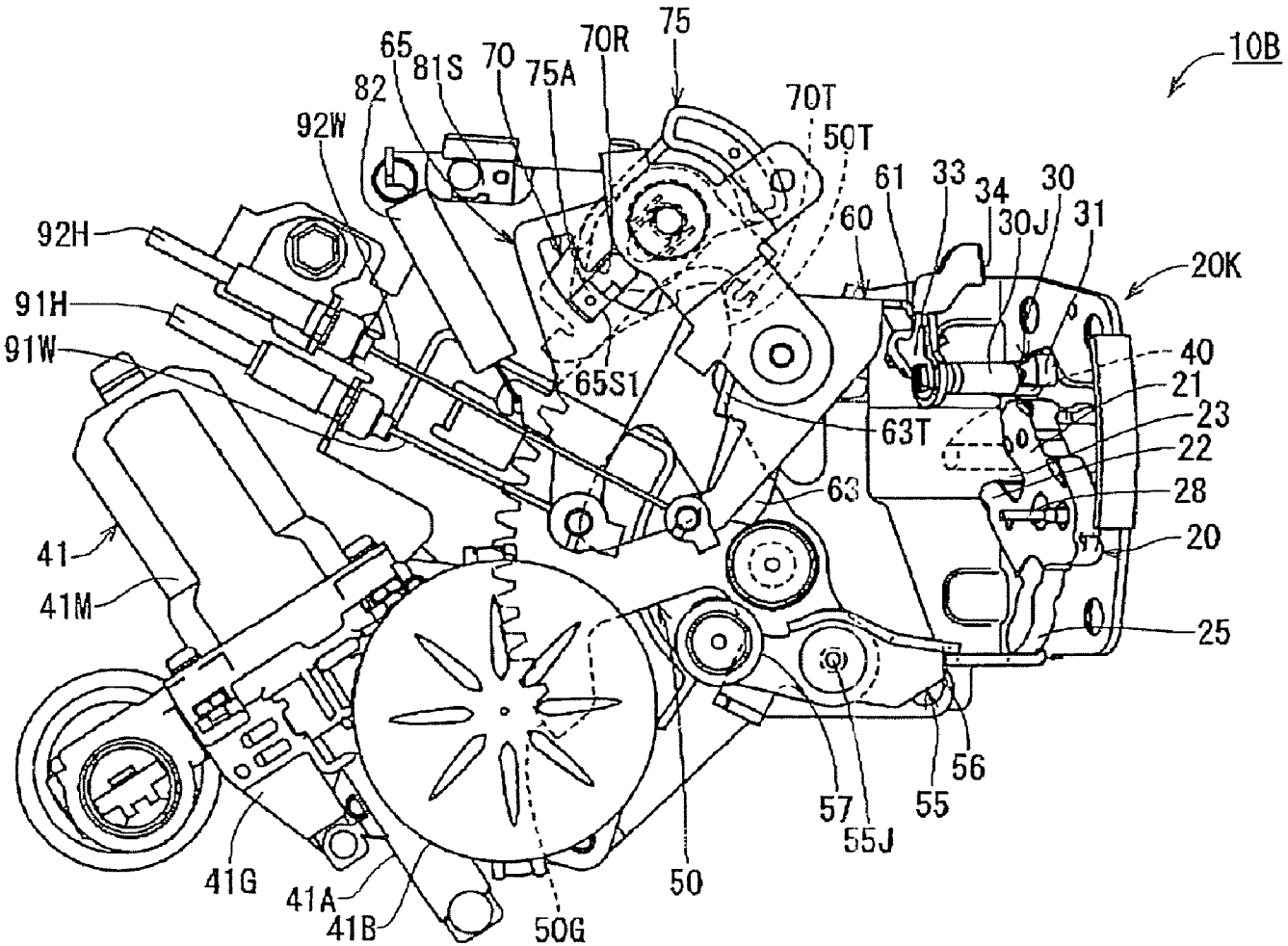
FIG. 11 is a front view of the closing device in a state that a pawl is moved to a release position by power transmitted from a latch driving motor.
Figure 12:
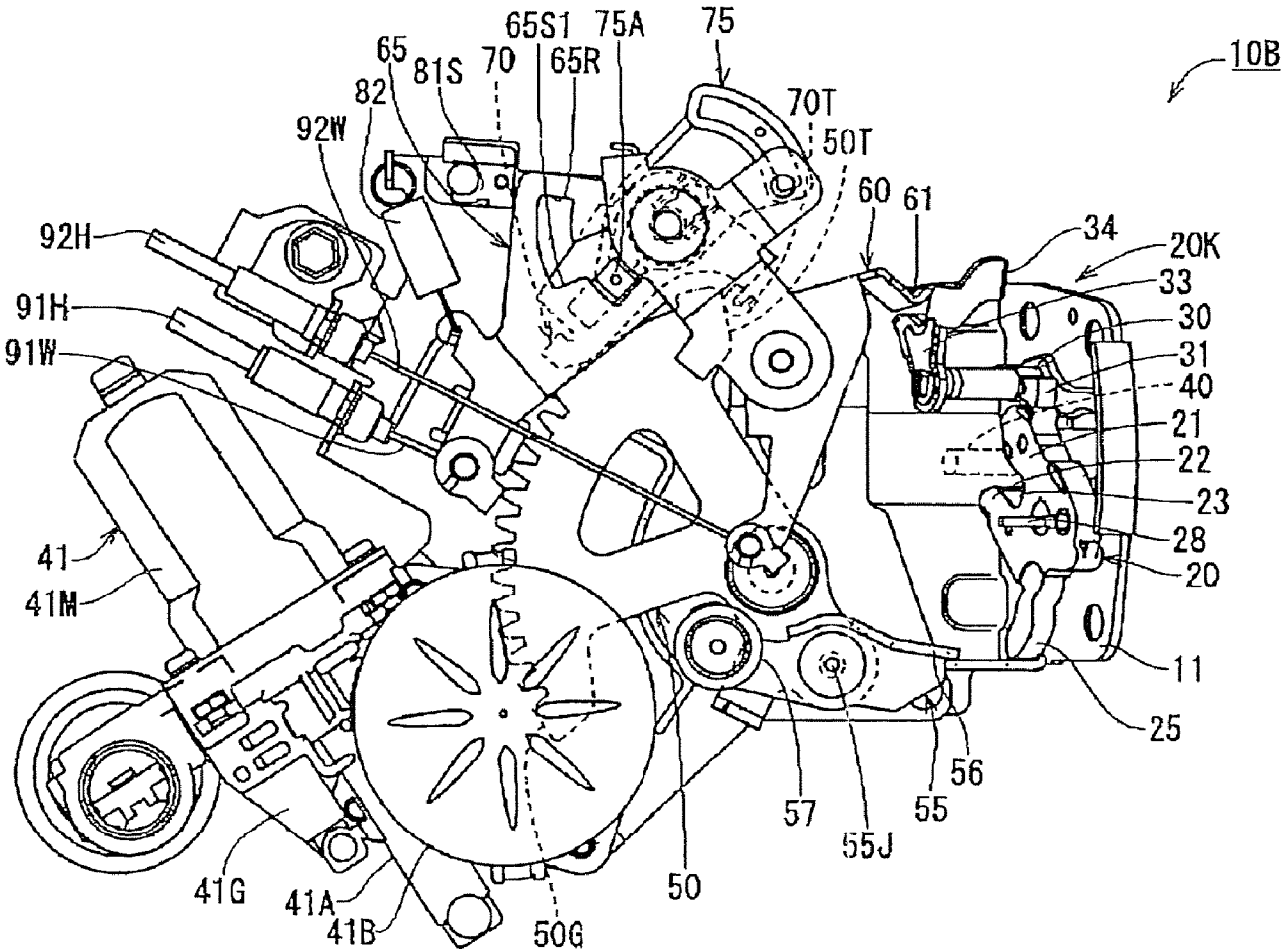
FIG. 12 is a front view of the closing device in a state that transmission of the power is shut off between the latch driving motor and the pawl in the case of abnormal stop in the latch driving motor.

As shown in FIG. 11, when the connecting rotation protrusion 75A comes in contact with the protrusion contacting portion 65S1, the sliding rotation board 75 may be moved to the power shutoff position to move the connecting rotation protrusion 75A to the inner circular arc groove 65R. Then, the transmission of the power is shut off from the connecting rotation protrusion 75A to the releasing lever 65 and the connecting rotation protrusion 75A freely rotates relative to the inner circular arc groove 65R2. Consequently, the transmission of the power and reaction force is shut off from the sliding rotation board 75 and the releasing lever 65.

The fully opened door locking device 10C includes a latch and pawl mechanism (not shown) which operates similarly to that of the closed door locking device 10A. Similarly to the closed door locking device 10A, the pawl of the fully opened door looking device 10C is provided with a pawl driving lever and an open cable 94W (refer to FIG. 2) is connected between the pawl driving lever and the remote control device 91.

Figure 16:
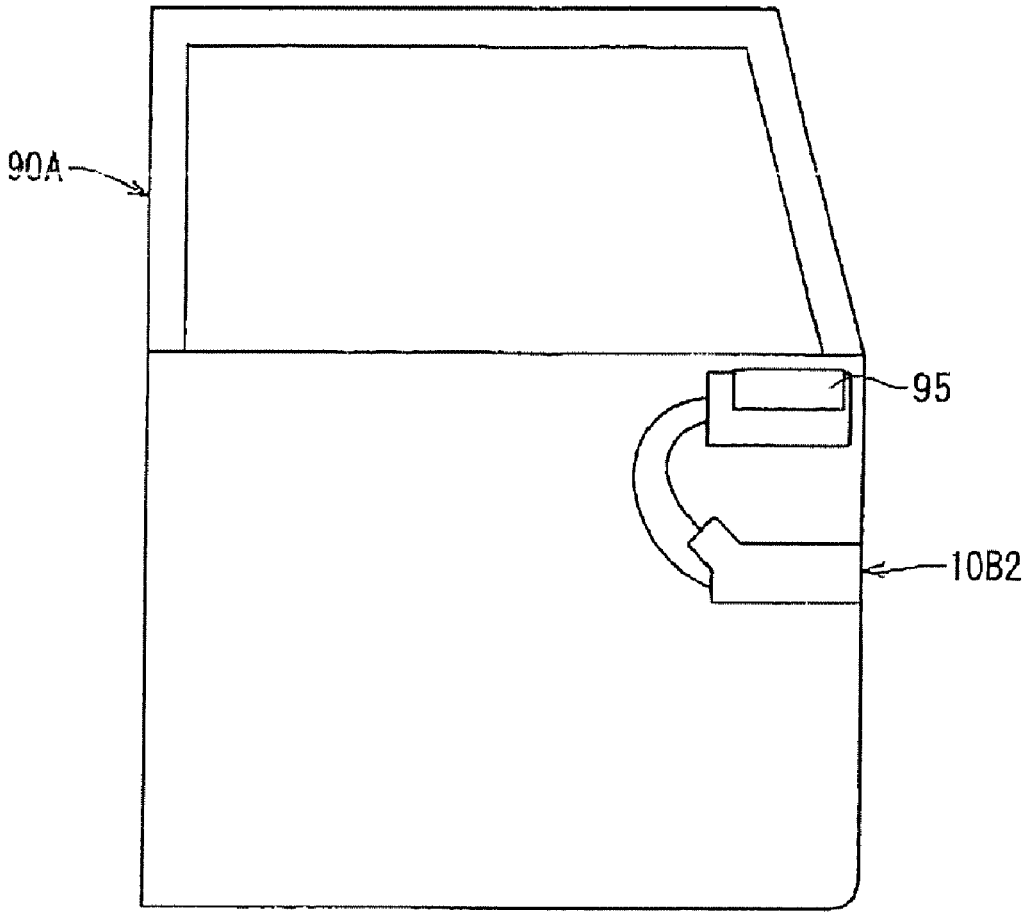
FIG. 16 is a schematic diagram of a pivotable door provided with a door locking system for a vehicle of modification 2.

As conceptually shown in FIG. 16, the remote control device 91 is provided with a remote control rotating lever 98 which is connected to the open cables 92W, 93W and 94W at one end thereof. The remote control rotating lever 98 is biased to and positioned at a home position (a position shown in FIG. 16) by a first holding spring 98S and a stopper 98T. Also, the releasing cable 91W is connected to the other end portion of the remote control rotating lever 98. The other end portion is located on the opposite side of the connected portion of the open cables 92W, 93W and 94W sandwiching the rotational center of the remote control rotating lever 98 therebetween. Thus, when the latch driving motor 41M is driven and the releasing cable 91W is drawn toward the closing device 10B, then the remote control rotating lever 98 rotates in a direction that moves away from the home position (the counter clockwise direction in FIG. 16). Consequently, the open cables 92W, 93W and 94W are drawn toward the remote control device 91. The movements of the open cables 92W, 93W and 94W move all pawls 30 of the closed door locking device 10A, the closing device 10B, and the fully opened door locking device 10C to the release positions to release the regulation on the rotations of all latches 20 at one time.

The remote control device 91 is provided with handles 95 which are separately provided at the inside and outside of the slide door 90. The handles 95 are biased to and held to a home position by a second holding spring 97S and a stopper 97T. When the handle 95 is moved in the direction that moves away from the home position against the second holding spring 97S, a handle linked member 97 linked to the handle 95 is moved from the home position and gets beyond a predetermined independent movable range L1 to contact with the remote control rotating lever 98. Then, the handle 95 is moved toward the direction that further moves away from the home position, the handle linked member 97 pushes the remote control rotating lever 98 to rotate. Also, the remote control device 91 is provided with a handle operation detecting sensor 96 for detecting that the handle linked member 97 enters into the solo movable range L1 from the home position. The detection signal of the handle operation detecting sensor 96 is read into the ECU (not shown) provided at the vehicle body 99 as well as the detection signal of the latch position detection sensor 83. The ECU drives the latch driving motor 41M based on the detection signals as detailed below.

The configuration of the embodiment is described above. Next, the effect of the embodiment will be described. When the slide door 90 is closed, each latch 20 of the closed door locking device 10A and the closing device 10D engages with the corresponding strikers 40 and rotates. At the time, if the slide door 90 is closed with a relatively large force to be in the fully closed state, each latch 20 of the closed door locking device 10A and the closing device 10B rotates to the full latched position as respectively shown in FIGS. 5 and 9. The latches 20 engage with the corresponding pawls 30 (more specifically, the latch rotation regulating piece 31 of the pawl 30) and the rotation of each latch 20 in the lock releasing direction is regulated (restricted). Thus, the slide door 90 is held in the fully closed state.

Figure 9:
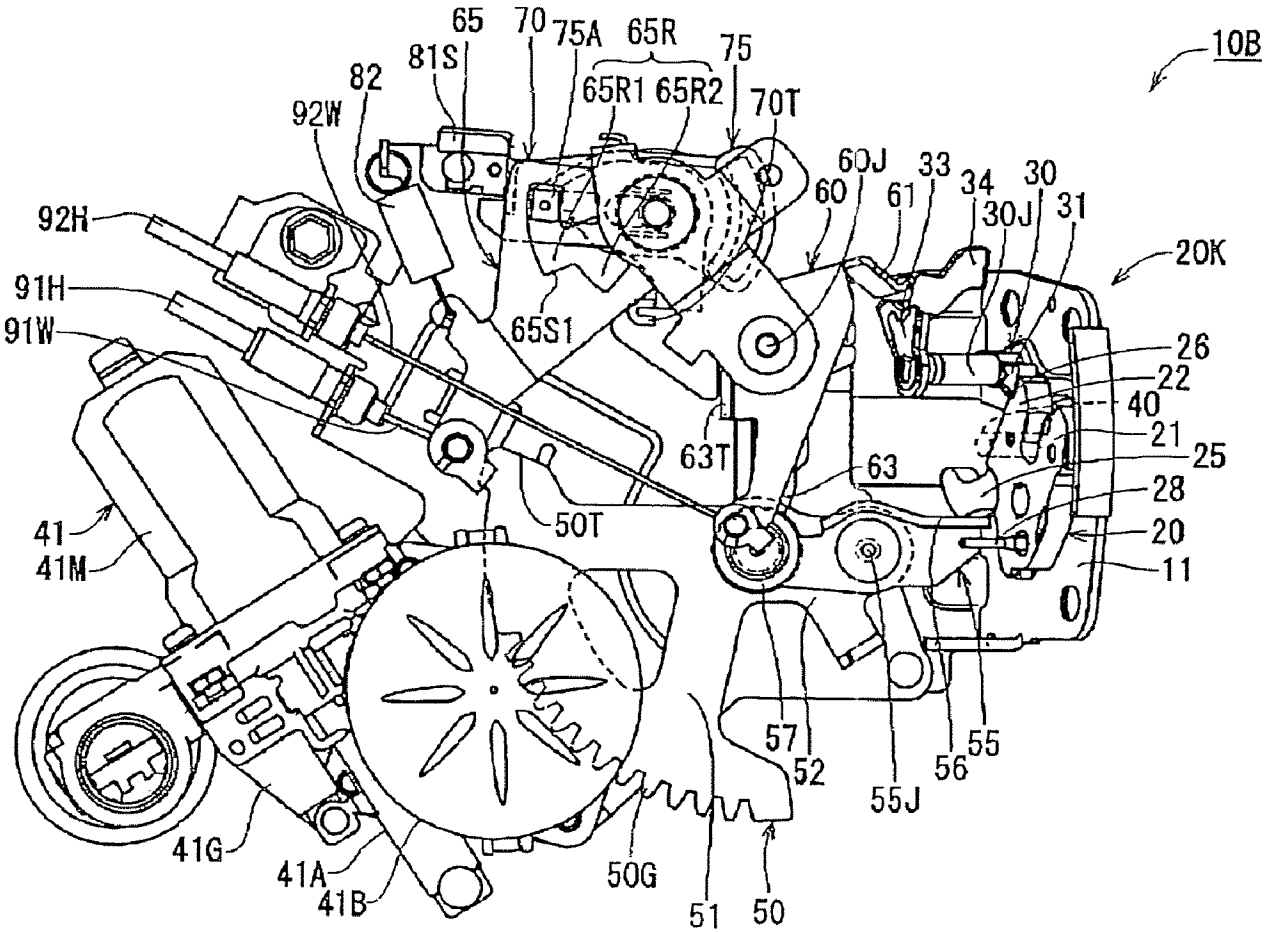
FIG. 9 is a front view of the closing device in the full latched state.

Also, if the slide door 90 is closed with a relatively small force and the door is brought in the half closed state, each latch 20 of the closed door locking device 10A and the closing device 10B rotates to the half-latched position as respectively shown in FIGS. 4 and 8 and the latches 20 engages with the corresponding pawls 30. The engagement regulates (restricts) the rotation of each latch 20 in the lock releasing direction and the slide door 90 is held in the half closed state. Then, the latch position detecting sensor 83 of the closing device 10B detects that the latch 20 is in the half-latched position, and the detected result is read into the ECU. The ECU rotates the motor output shaft of the latch driving motor 41M provided at the closing device 10B in one direction and the active lever 50 is rotationally driven in the counter clockwise direction of FIG. 8. At this time, the positioning lever 63 contacts with the contacting roller 57 to position the one end of the swing type rotation board 55 and the rotational shaft 55J of the swing type rotation board 55 is moved upwardly by the active lever 50. By the movement of the swing type rotation board 55, the power is transmitted from the active lever 50 to the swing type rotation board 55 (more specifically, the distal end portion of the push-up wall 56 provided at the swing type rotation board 55) and the other end portion of the swing type rotation board 55 pushes up the latch driving lever 25 of the latch 20. Thus, the latch 20 moves from the half-latched position, which is shown in FIG. 8, to the full latched position, which is shown in FIG. 9, and the slide door 90 is brought from the half closed state to the fully closed state to be held therein.

Here, if the handle 95 is operated in the process of shifting the slide door 90 from the half-closed state to the fully closed state, then the open cable 92W is drawn to the remote control device 91 and the positioning lever 63 moves away from the contacting roller 57 of the swing type rotation board 55. The transmission of the power is instantly shut off from the active lever 50 to the swing type rotation board 55 by the above-described movement of the positioning lever 63, and the operation for shifting from the half closed state to the fully closed state is cancelled. Also, the opening lever 60 rotates in conjunction with the operation of the handle 95 and the push-down piece 61 of the opening lever 60 pushes down the pawl driving lever 33 of the pawl 30. Thus, even if the pawl 30 of the closing device 10B engages with the latch 20, it is possible for the pawl 30 to move to the release position. Also, the open cable 93W is drawn toward the remote control device 91 by the operation of the handle 95. Thus, the pawl 30 of the closed door locking device 10A moves to the release position and thereby opening the slide door 90.

When the slide door 90 is brought in the fully closed state, the sound-proofing member is strongly pressed between the slide door 90 and the door frame 99W and the respective pawls 30 of the closed door locking device 10A and the closing device 10B frictionally engage with the corresponding latches 20 by the reaction force of the sound-proofing member. Meanwhile, in order to open the slide door 90, it is necessary that the both pawls 30 of the closed door locking device 10A and the closing device 10B move to the release position against the frictional resistance between the pawls 30 and the latches 20, and a large force is required for moving the both pawls 30 to the release positions 30 by the manual operation. However, in the embodiment, if the handle 95 is operated, the handle operation detecting sensor 96 detects whether or not the handle 95 is operated before the frictional resistance between the pawl 30 and the latch 20 is applied to the handle 95. Then, the ECU receives the detected result and rotates the motor output shaft of the latch driving motor 41M in the other direction based on the detected result.

Figure 10:
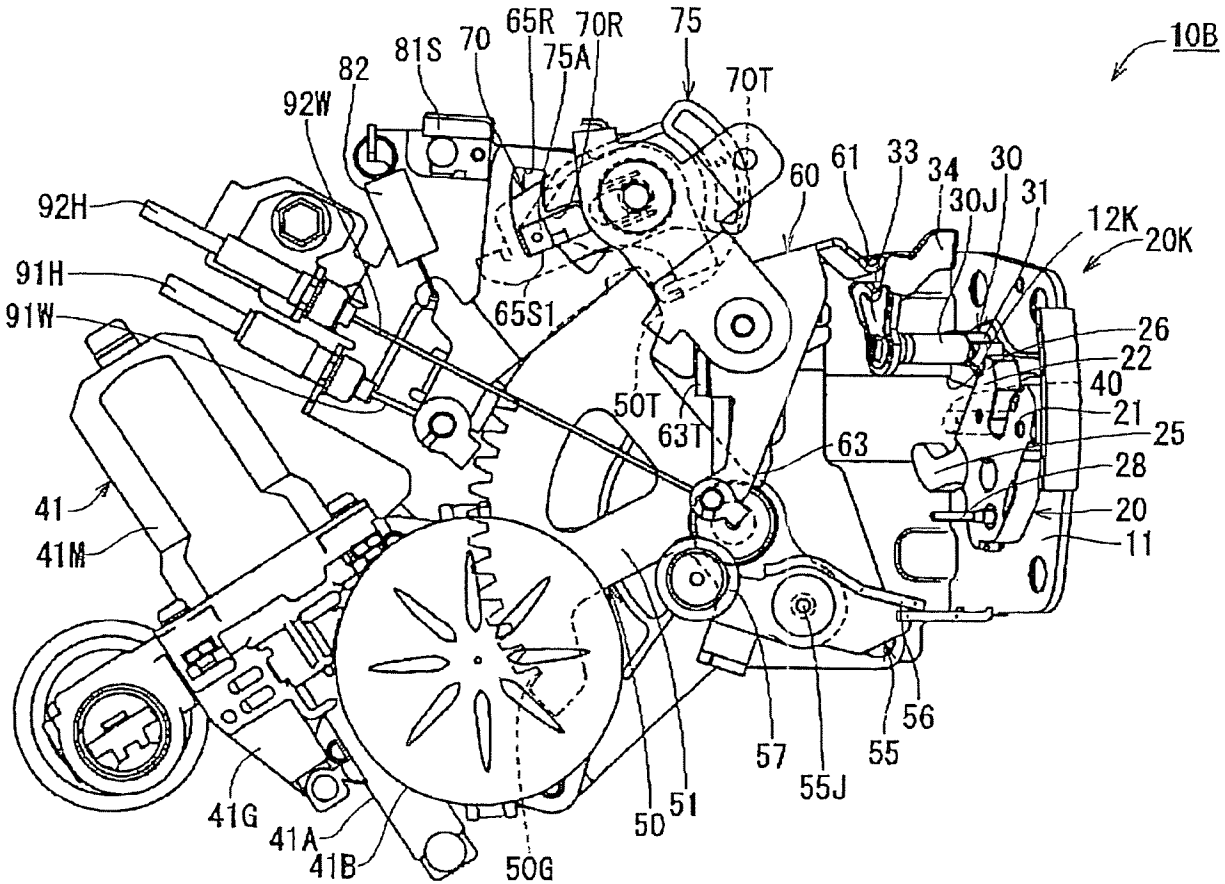
FIG. 10 is a front view of the closing device in a state that power is transmitted to a releasing lever.

Then, the active lever 50 is rotationally driven in the clockwise direction in FIG. 10. The release input board 70 and the sliding rotation board 75 rotate in the counter clockwise direction of the FIG. 10 after receiving the power from the active lever 50. Subsequently, the connecting rotation protrusion 75A of the sliding rotation board 75 contacts with the protrusion contacting portion 65S1 located at the one end of the outer circular arc groove 65R1 of the releasing lever 65. As shown in a change observed in FIGS. 10 and 11, the releasing lever 65 rotates together with the release input board 70 and the sliding rotation board 75 to draw the open cable 91W toward the closing device 10B. Then, the remote control rotating lever 98 of the remote control device 91 rotates and the open cables 92W and 93W are drawn toward the remote control device 91. Consequently, the both pawls 30 of the closed door locking device 10A and the closing device 10B are moved to the release positions by the power of the latch driving motor 41M, thereby opening the slide door 90 easily.

When the slide door 90 is brought in the fully open state, the latch 20 (not shown) of the fully opened door locking device 10C engages with the striker 40 and the pawl 30 frictionally engages with the latch 20. In this case, the open cable 94W is drawn toward the remote control device 91 by operating the handle 95 and the pawl 30 of the fully opened door locking device 10C is moved to the release position by the power of the latch driving motor 41M, thereby closing the slide door 90 easily.

Here, as shown in FIG. 11, in the event that the release input board 70 and the sliding rotation board 75 abnormally stop together with the latch driving motor 41M while the open cable 92W is drawn from the remote control device 91 toward the closing device 10B, the ECU detects the abnormal stop based on the energized condition of the latch driving motor 41M and the like to light up a warning lamp (not shown) of the driver's seat (corresponding to a abnormity alarming means). In this case, the driver may move the sliding rotation board 75 to the power shutoff position. Then, the contact between the connecting rotation protrusion 75A and the protrusion contacting portion 65S1 is released and the connecting rotation protrusion 75A is received by the inner circular arc groove 65R2. The warning lamp is lit off by detecting that the sliding rotation board 75 is positioned at an appropriate position. Then, the transmission of the power is shut off from the connecting rotation protrusion 75A to the releasing lever 65. The releasing lever 65 is drawn by the spring 82 to return the original position and the connecting rotation protrusion 75A rotates relative to the inner circular arc groove 65R2. In conjunction with the return of the releasing lever 65, the remote control rotating lever 98 returns the original position. Thus, even if the latch driving motor 41M stops abnormally, all pawls 30 of the closed door locking device 10A, the closing device 10B and the fully opened door locking device 10C are returned from the release positions to the positions that the pawls 30 engage with the corresponding latches 20. Therefore, it is possible to hold the slide door 90 in the closed state.

As just described, according to the embodiment of the door locking system for the vehicle 10, the latch driving motor 41M is used as two power sources, one is used for shifting the slide door 90 from the half closed state to the fully closed state and the other is used for assisting the handle operation when opening the slide door 90, and thus the manufacturing cost and weight are decreased. Also, when the latch driving motor 41M becomes inoperative while the latch driving motor 41M holds the pawl 30 at the release position, the abnormality is alarmed by the warning light. Thus, it is possible to deal with the abnormality swiftly. In addition to the warning light, a warning beep and an alarm may be employed as the abnormality alarming means.

OTHER EMBODIMENTS

The present invention is not limited to the aforementioned embodiment. For example, the below-described embodiment may be included in the technical scope of the present invention. Further, in addition to the below-described modification, various changes may be resorted to without departing from the spirit of the invention.

Figure 15:
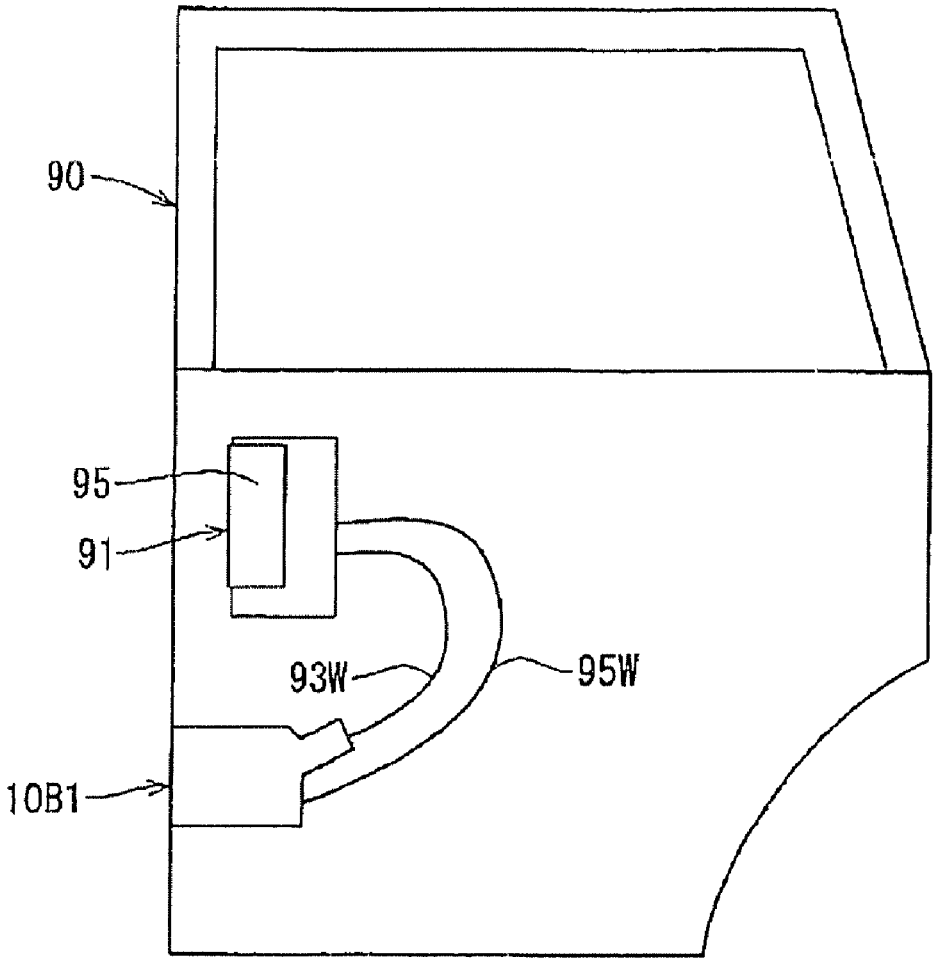
FIG. 15 is a schematic diagram of a slide door provided with a door locking system for a vehicle of modification 1.

(1) The door locking system for the vehicle 10 according to the embodiment is provided with the closed door locking device 10A, the closing device 10B, and the fully opened door locking device 10C. However, as shown in FIG. 15, the present invention may be applied to a slide door locking system for a vehicle which is provided with a closed door locking device 10B1. The closed door locking device 10B1 is provided with the closing device 10B, the actuator 41 and the power transmission system switching mechanism, at the front end portion of the slide door 90 and does not have the closing device 10B and the fully opened door locking device 10C. Also, the present invention may be applied to a slide door locking system for a vehicle which is provided with the closed door locking device 10B1 and the fully opened door locking device 10C but does not have the closing device 10B. Further, the present invention may be applied to a door locking system for a vehicle which is provided with the closed door locking device 10A, the closing device 10B, which are described in the embodiment, but does not have the fully opened door locking device 10C.

(2) The door locking system for the vehicle 10 according to the embodiment is mounted to the slide door 90. However, as shown in FIG. 16, the present invention may be applied to a door locking system of a pivotable door 90A which is rotatably provided at the vehicle body and is provided with a pivotable door locking device 10B2. In this case, the pivotable door locking device 10B2 should be provided with the latch and pawl mechanism, the actuator 41 and the power transmission system switching mechanism.

(3) In the embodiment, when the latch driving motor 41M abnormally stops, the power transmission system is shut off between the latch driving motor 41M and the pawl 30 by operating the cancel operating protrusion 75B provided at the closing device 10B. However, other configuration may be employed for this function as below. The transmission of the power is retained between the latch driving motor 41M and the pawl 30 while the handle 95 is moving from a starting end portion to a terminal end portion of the movable range thereof, and the transmission of the power is shut off when the handle 95 reaches the terminal end portion of the movable range. Further, the door locking system may be configured so that the power transmission is returned to a transmittable state when the handle 95 returns to the starting end portion of the movable range.

(4) In the embodiment, the cancel operating protrusion 75B, which is operated when the latch driving motor 41M abnormally stops, may be disposed on an inner surface of the slide door 90 facing the inside of the vehicle cabin. For example, the cancel operating protrusion 75B may be disposed on a surface of the door, which faces an inner surface of the door frame, so that the cancel operating protrusion 75B is covered between the door and the vehicle body when the door is closed. So configured, the cancel operating protrusion 75B is not easily recognizable by a person that is not familiar with the purpose of the operation thereof, thus preventing accidental operations.

According to the configuration of the embodiment, the motor output shaft of the latch driving motor 41M rotates in the one direction in the half closed state and shifts the slide door 90 to the completely closed state. Additionally, when the handle 95 is operated in the completely closed state, the motor output shaft of the latch driving motor 41M rotates in the other direction to move the pawl 30 to the release position against the frictional force between the pawl 30 and the latch 20 and thereby opening the slide door 90. As just described, the latch driving motor 41M is used as two power sources, i.e. a power source for shifting the slide door 90 firm the half closed state to the completely closed state and a power source for assisting the operation of the handle 95 to open the slide door 90. Therefore, the manufacturing cost and the weight are decreased. A handle, a wireless remote controller, and the operator's switch and the like may be employed as the lock release operating portion.

According to the configuration of the embodiment, if the latch driving motor 41M stops while holding the pawl 30 at the release position, the power is shut off in the first canceling mechanism and thus the power and the reaction force are shut off from the motor output shaft to the pawl 30 to move the pawl 30 from the release position to the position in which the pawl 30 engages with the latch 20. Thus, the door 90 is locked being in the completely closed state.

According to the above-described configuration of the embodiment, in the case that the latch driving motor 41M operates normally, the sliding rotation board 75 is positioned at the power transmitting position. Then, the connecting rotation protrusion 75A of the sliding rotation board 75 is rotated after receiving the power from the latch driving motor 41M to push the releasing lever 65. Consequently, the releasing lever 65 is rotated to move the pawl 30 to the release position. Also, when the latch driving motor 41 operates abnormally, the slide rotation board 75 is positioned at the power shutoff position. Then, the connecting rotation protrusion 75A is received by the inner circular arc groove 65R2 and relatively rotates therein. Thus, the releasing lever 65 is rotated independently from the slide rotation board 75, and the pawl 30 is moved from the release position to the position that the pawl 30 engages with the latch 20. Thus, the door 90 is locked in the completely closed state.

According to the above-described configuration of the embodiment, the first canceling mechanism is switched between the power transmitting state and the power shutoff state by operating the cancel operating protrusion 75B manually.

According to the above-described configuration of the embodiment, in the case that the latch driving motor 41M operates normally, the pawl 30 is moved to the release position by the power of the latch driving motor 41M while the handle 95 is being moved from the starting end portion before the terminal end portion of the movable range of the handle 95. Also, even if the latch driving motor 41M is abnormally stopped at any position, the first canceling mechanism is switched to the power shutoff state when the handle 95 reaches the terminal end portion of the movable range. Thus, the pawl 30 moves from the release position to the position that the pawl 30 engages with the latch 20 when returning the handle 95 to the staring end portion of the movable range. Therefore, even if the latch driving motor 41M abnormally stops at any position, it is still possible to lock the door in the completely closed state.

According to the configuration, even if the latch driving motor 41M abnormally stops in the condition that the motor output shaft of the latch driving motor 41M is connected to the latch 20 and the latch 20 engages with the striker 40, it is still possible to open the door 90. The second canceling mechanism is switched to the power shutoff state and thus the power and the reaction force is shut off from the motor output shaft to the latch 20. Then, the engagement between the latch 20 and the striker 40 is disengaged when the pawl 30 is moved to the release position.

According to the configuration of the embodiment, the positioning lever 63 is disposed at the position with which the swing type rotation board contacts and positions the one end portion of the swing type rotation board 55 unless the handle 95 is operated. Then, when the latch driving motor 41M rotates the active lever 50, the rotational shaft 55J of the swing type rotation board 55 moves in conjunction with the rotation of the active lever 50. Consequently, the power is transmitted to the latch 20 from the other end of the swing type rotation board 55, and thereby bringing the door 90 from the half closed state to the completely closed state. Also, if the handle 95 is operated, the positioning lever 63 is disposed at a position that the swing type rotation board 55 is released and rotates freely relative to the active lever 50. Consequently, the power is shut off from the other end of the swing type rotation board 55 to the latch 20 and the engagement between the latch 20 and the striker 40 is disengaged. Thus, the door 90 is opened.

When the plural latches 20 and pawls 30 are provided at the single door 90, the fictional resistance increases for moving the pawl 30 to the release position. However, in the configuration according to the embodiment, all pawls 30 are moved to the release position by the latch driving motor 41M.

According to the configuration, the opening and closing operation of the slide door 90 provided with the closing device 10B, which is used for closing the slide door 90 from the half closed state to the completely closed state, and the closed door locking device 10A, which holds the slide door in the completely closed state, is easily carried out by the power of the latch driving motor 41M. Further, the opening and closing operation of the slide door 90 provided with the full-open door locking device 10C, which holds the slide door 90 in the full-open state, is easily carried out by the power of the latch driving motor. Furthermore, the opening and closing operation of the pivotable door 90A provided with the pivotable door locking device 10B2 which holds the pivotable door 90A in the full-open state is carried out by the power of the latch driving motor 41M.

The principles, of the preferred embodiments and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A door locking system for a vehicle, comprising:

a striker adapted to be provided at a vehicle body;

a latch adapted to be mounted to a vehicle door, the latch engaging with the striker and rotating;

a pawl engaging with the latch, the pawl allowing the latch to rotate in a locking direction that strengthens the engagement between the latch and the striker and regulating the latch to rotate in a lock releasing direction that is a reverse direction of the locking direction;

a lock release operating portion moving the pawl to a release position to release the regulation on the rotation of the latch;

a latch driving motor rotationally driven in one direction to rotationally drive the latch in the locking direction to shift the door to a fully closed state in which the door is completely closed when the vehicle door falls into a half closed state, the latch driving motor rotationally driven in the other direction to move the pawl to the release position when the lock release operating portion is operated;

a power transmission system switching mechanism disposed between the latch driving motor, the pawl and the latch, the power transmission system switching mechanism connecting a motor output shaft of the latch driving motor, which is rotationally driven in the one direction, to the latch for rotationally driving the latch in the locking direction, and connecting the motor output shaft of the latch driving motor, which is rotationally driven in the other direction, to the pawl for moving the pawl to the release position, the power transmission system switching mechanism including a first canceling mechanism for switching a power state between a power transmitting state, in which power and a reaction force are transmitted from the motor output shaft to the pawl, and a power shutoff state, in which the power and the reaction force are shut off from the motor output shaft and the pawl; and wherein the latch includes plural latches and the pawl includes plural pawls provided for a single vehicle door, the latch driving motor being provided for the single vehicle door, the power transmission system switching mechanism being configured so that the motor output shaft rotationally driven in the one direction is connected to all of the plural latches and the motor output shaft rotationally driven in the other direction is connected to all of the pawls.

2. A door locking system for a vehicle according to claim 1, wherein the first canceling mechanism includes:

a sliding rotation portion receiving the power from the motor output shaft rotationally driven in the other direction for rotating, the sliding rotation portion moving between a power transmitting position to a power shutoff position in a direction that intersects with a rotational shaft of the sliding rotation portion;

a connecting rotation protrusion formed in a position offset from the rotational shaft of the sliding rotation portion;

a releasing rotation portion provided so as to rotate about a common axis of the rotational shaft of the sliding rotation portion, the releasing rotation portion receiving the power from the connecting rotation protrusion to rotate and thereby moving the pawls to the release position when the sliding rotation portion is positioned at the power transmitting position; and a protrusion receiving portion being formed at the releasing rotation portion, the protrusion receiving portion rotatably receiving the connecting rotation protrusion to shut off the power from the connecting rotation protrusion to the releasing rotation portion when the sliding rotation portion is positioned at the power shutoff position.

3. A door locking system for a vehicle according to claim 1, further comprising:

a cancel operating portion switching the first canceling mechanism between the power transmitting state and the power shutoff state by manual operation.

4. A door locking system for a vehicle according to claim 3, the cancel operating portion adapted to be disposed and sandwiched between the vehicle door and the vehicle body to be covered therebetween.

5. A door locking system for a vehicle according to claim 1, wherein the lock release operating portion includes a handle adapted to be provided at the vehicle door and the first canceling mechanism is configured so that the power transmitting state is held while the handle is being moved from a starting end portion of a movable range to a terminal end portion thereof and is switched to the power shutoff state when the handle reaches the terminal end portion of the movable range, further, the power status returns to the power transmitting state when the handle returns to the starting end portion of the movable range.

6. A door locking system for a vehicle according to claim 1, further comprising:

an abnormality alarming means alarming abnormality when the latch driving motor becomes inoperative holding each pawl at the release position.

7. A door locking system for a vehicle according to claim 1, wherein the power transmission system switching mechanism further includes a second canceling mechanism switching the power state between a power transmitting state, in which the power and the reaction force are transmitted from the motor output shaft to each latch, and a power shutoff state, in which the power and the reaction force are shut off from the motor output shaft and each latch.

8. A door locking system for a vehicle according to claim 7, wherein the second canceling mechanism includes:

an active rotation portion receiving the power from the motor output shaft rotationally driven in the other direction to rotate;

a swing rotation portion rotatably journalled at a position offset from a rotational shaft of the active rotation portion;

a movable positioning member normally positioned at a contacting position of the swing rotation portion, in which one end portion of the swing rotation portion is positioned, and moving to a releasing position of the swing rotation portion, in which the positioning of the swing rotation portion is released, in response to operation of the lock release operating portion, wherein a rotational shaft of the swing type rotation portion moves in conjunction with rotation of the active rotation portion with the one end portion of the swing rotation portion positioned by the movable positioning member and thereby providing the power to the latch from the other end portion of the swing rotation portion when the movable positioning member is positioned at the contacting position of the swing rotation portion, the swing rotation portion becomes freely rotatable relative to the active rotation portion to shutoff the power to each latch when the movable positioning member is positioned at the releasing position of the swing rotation portion.

9. A door locking system for a vehicle according to claim 1, wherein the vehicle door is a slide door and includes:

a closing device disposed at a rear end side of the slide door and having the latch driving motor, one of the latches and one of the pawls to bring the slide door from the half closed state to the fully closed state;

a closed door locking device disposed at a front end side of the slide door and having another one of the latches and another one of the pawls to hold the slide door in the fully closed state, and the power transmission system switching mechanism is configured so that the motor output shaft rotationally driven in the one direction is connected only to the latch of the closing device and the motor output shaft rotationally driven in the other direction is connected to all of the pawls.

10. A door locking system for a vehicle according to claim 9, further comprising:

a fully opened door locking device disposed at a front end side of the slide door and having another one of the latches and another one of the pawls to hold the side door in a fully opened state, wherein the power transmission system switching mechanism is configured so that the motor output shaft rotationally driven in the other direction is connected to the pawl of the fully opened door locking device.

11. A door locking system for a vehicle according to claim 1, wherein the door is a pivotable door and includes;

a pivotable door locking device disposed at an end portion of the pivotable door which is apart from a pivotal center of the pivotable door and having the latch driving motor, one of the latches and one of the pawls to hold the pivotable door in the fully closed state, and the power transmission system switching mechanism is configured so that the motor output shaft rotationally driven in the one direction is connected to the latch of the pivotable door locking device and the motor output shaft rotationally driven in the other direction is connected to the pawl of the pivotable door locking device.

12. A door locking system for a vehicle, comprising:

a striker adapted to be provided at a vehicle body;

a latch adapted to be mounted to a vehicle door, the latch engaging with the striker and rotating;

a pawl engaging with the latch, the pawl allowing the latch to rotate in a locking direction that strengthens the engagement between the latch and the striker and regulating the latch to rotate in a lock releasing direction that is a reverse direction of the locking direction;

a lock release operating portion moving the pawl to a release position to release the regulation on the rotation of the latch;

a latch driving motor rotationally driven in one direction to rotationally drive the latch in the locking direction to shift the door to a fully closed state in which the door is completely closed when the vehicle door falls into a half closed state, the latch driving motor rotationally driven in the other direction to move the pawl to the release position when the lock release operating portion is operated;

a power transmission system switching mechanism disposed between the latch driving motor, the pawl and the latch, the power transmission system switching mechanism connecting a motor output shaft of the latch driving motor, which is rotationally driven in the one direction, to the latch for rotationally driving the latch in the locking direction, and connecting the motor output shaft of the latch driving motor, which is rotationally driven in the other direction, to the pawl for moving the pawl to the release position, the power transmission system switching mechanism including a first canceling mechanism for switching a power state between a power transmitting state, in which power and a reaction force are transmitted from the motor output shaft to the pawl, and a power shutoff state, in which the power and the reaction force are shut off from the motor output shaft and the pawl;

wherein the latch includes plural latches and the pawl includes plural pawls for a single vehicle door, the latch driving motor being provided for the single vehicle door, the power transmission system switching mechanism being configured so that the motor output shaft rotationally driven in the one direction is connected to all of the plural latches and the motor output shaft rotationally driven in the other direction is connected to all of the pawls;

a remote control device;

an opening lever rotatable about a common rotational shaft of a movable positioning member;

an open cable connecting the open lever with the remote control device;

a releasing cable connecting a releasing rotation portion to the remote control device; and the driving of the latch driving motor in the other direction causing the releasing cable and the open cable to be drawn toward the remote control device, with the regulation on the rotations of all of the latches being released at one time.

13. A door locking system for a vehicle according to claim 12, wherein the first canceling mechanism comprises a sliding rotation board rotatably mounted for rotation about a rotational shaft, the sliding rotation board including a connecting rotation protrusion projecting from the sliding rotation board and disposed at one end of the sliding rotation board, the sliding rotation board also including a cancel operating portion positioned at an opposite end of the sliding rotation board so that the rotational shaft is positioned between the connecting rotation protrusion and the cancel operating portion.

14. A door locking system for a vehicle according to claim 12, wherein rotational driving of the latch driving motor is transferred to one of the latches by a rotatable active rotation portion which contacts and transmits power to a rotatable swing rotation portion while the swing rotation portion is in contact with the movable positioning member, the remote control device comprising a handle connected to the opening lever by the open cable, the handle being configured such that operation of the handle while the latch driving motor is rotationally driving in the one direction draws the open cable towards the handle and causes the movable positioning member to move out of contact and away from the swing rotation portion so that power transmission to the rotatable swing rotation portion instantly stops and shifting of the door to the fully closed state is cancelled.

15. A door locking system for a vehicle according to claim 12, wherein rotational driving of the latch driving motor is transmitted to a rotatable active rotation portion which contacts and transmits power to a rotatable swing rotation portion while the swing rotation portion is in contact with the movable positioning member, the swing rotation portion being rotatable into contact with a latch driving lever of one of the latches, the rotational driving of the latch driving motor in the one direction rotating the active rotation portion into contact with the swing rotation portion to rotate the swing rotation portion into contact with the latch driving lever of the one latch to move the one latch in the locking direction to shift the one latch from a half-latched condition to a fully-latched condition so the door is shifted to a fully closed state.

16. A door locking system for a vehicle according to claim 12, wherein the motor output shaft of the latch driving motor engages an active rotation portion so that the rotation driving of the latch driving motor in the other direction rotates the active rotation portion; the first canceling mechanism comprising a release input board, a sliding rotation board and a releasing rotation portion which are all rotatably mounted on a common shaft; the active rotation portion contacting the release input board as the active rotation portion is rotated by the rotation driving of the latch driving motor in the other direction, the sliding rotation board including a protruding connecting rotation protrusion which is positioned in a groove in the releasing rotation portion; the releasing rotation portion being connected to the releasing cable which is connected to a rotating lever of the remote control device, the opening lever of the remove control device also being connected to the rotating lever; the rotation driving of the latch driving motor in the other direction rotates the active rotation portion to rotate the release input board, the sliding rotation board and the releasing rotation portion to thereby pull the release cable and draw the opening cable towards the remote control to move the opening lever and cause a portion of the opening lever to contact a portion of one of the pawls to the release position.

17. A door locking system for a vehicle according to claim 12, wherein the opening cable is a first opening cable connected to a rotatable lever of the remote control device, and further comprising second and third opening cables each connected to the rotatable lever of the remote control device, each of the second and third opening cables being operatively connected to a respective one of the pawls so that drawing the second and third opening cables towards the remote control device moves the respective pawl to the release position, the releasing cable also being connected to the rotatable lever of the remote control device.

18. A door locking system for a vehicle according to claim 12, wherein the power transmission system switching mechanism includes an active lever having a plate provided with teeth that mesh with the motor output shaft, and a swing rotation board provided with a contacting roller; the movable positioning member possessing an end portion which contacts the contacting roller during the power transmitting state, the swing rotation board having a wall which contacts a latch driving lever operatively connected to one of the latches.

* * * * *